US008398457B2

(12) United States Patent
King et al.

(10) Patent No.: US 8,398,457 B2
(45) **Date of Patent: *Mar. 19, 2013**

(54) MULTI-SANDER

(75) Inventors: Wade C. King, Finksburg, MD (US); Micah A. Coleman, Baltimore, MD (US); Andrew Walker, Durham (GB); Jason McRoberts, Red Lion, PA (US); Frederick R. Bean, Finksburg, MD (US); Christopher J. Murray, Baltimore, MD (US); Frank A. DeSantis, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/465,631

(22) Filed: May 7, 2012

(65) Prior Publication Data

US 2012/0220203 A1 Aug. 30, 2012

Related U.S. Application Data

(63) Continuation of application No. 12/540,189, filed on Aug. 12, 2009, now Pat. No. 8,172,642.

(60) Provisional application No. 61/090,417, filed on Aug. 20, 2008.

(51) Int. Cl.
*B24B 49/00* (2006.01)

(52) U.S. Cl. ..... 451/5; 451/8; 451/57; 451/357

(58) Field of Classification Search ..... 451/5, 8, 451/10, 57, 357; 700/168

See application file for complete search history.

(56) References Cited

U.S. PATENT DOCUMENTS

| | | | |
|---|---|---|---|
| 1,965,669 | A | 7/1934 | Robb |
| 2,898,616 | A | 8/1959 | Coover |
| 3,390,412 | A | 7/1968 | Wolter |
| 3,533,193 | A | 10/1970 | Dudek |
| 3,566,895 | A | 3/1971 | Goto |
| 3,724,237 | A | 4/1973 | Wood |
| 3,759,336 | A | 9/1973 | Marcovitz et al. |
| 3,761,663 | A | 9/1973 | Brown |
| 3,793,776 | A | 2/1974 | Sadow, Jr. et al. |
| 3,841,416 | A | 10/1974 | Pfister |
| 3,874,125 | A | 4/1975 | Stroezel |
| 3,899,852 | A | 8/1975 | Batson |
| 3,908,139 | A | 9/1975 | Duncan, Jr. |
| 4,103,511 | A | 8/1978 | Kress et al. |
| 4,125,339 | A | 11/1978 | Pittinger, Sr. et al. |
| 4,251,120 | A | 2/1981 | Wolff |

(Continued)

FOREIGN PATENT DOCUMENTS

| | | | |
|---|---|---|---|
| CN | 2074697 | U | 4/1991 |
| DE | 1902315 | A1 | 9/1969 |

(Continued)

*Primary Examiner* — Maurina Rachuba

(74) *Attorney, Agent, or Firm* — Harness, Dickey & Pierce, P.L.C.

(57) ABSTRACT

A tool for moving an abrasive media can include a tool body and a drive system housed in the tool body. The drive system can include an output member. A retaining member can be disposed on the tool body. A first platen having a first attachment hub can be selectively coupled with the retaining member in an installed position. The first platen can have a first rotatable member that selectively attaches to the output member in a first mode of operation. A second platen having a second attachment hub can selectively couple with the retaining member in an installed position. The second platen can have a second rotatable member that selectively attaches to the output member in a second mode of operation.

19 Claims, 19 Drawing Sheets

U.S. PATENT DOCUMENTS

| | | | |
|---|---|---|---|
| RE30,680 | E | 7/1981 | Kress et al. |
| 4,307,325 | A | 12/1981 | Saar |
| 4,355,251 | A | 10/1982 | Alessio et al. |
| 4,410,846 | A | 10/1983 | Gerber et al. |
| 4,504,769 | A | 3/1985 | Fushiya et al. |
| 4,513,381 | A | 4/1985 | Houser, Jr. et al. |
| 4,628,459 | A | 12/1986 | Shinohara et al. |
| 4,728,942 | A | 3/1988 | England |
| 4,754,575 | A | 7/1988 | Schneider |
| 4,871,629 | A | 10/1989 | Bunyea |
| 5,018,314 | A | 5/1991 | Fushiya et al. |
| 5,128,783 | A | 7/1992 | Abileah et al. |
| 5,157,873 | A | 10/1992 | Rudolf et al. |
| 5,241,053 | A | 8/1993 | Fujisawa et al. |
| 5,296,768 | A | 3/1994 | Burger et al. |
| 5,374,088 | A | 12/1994 | Moretti et al. |
| 5,386,667 | A | 2/1995 | Hausslein et al. |
| 5,392,568 | A | 2/1995 | Howard, Jr. et al. |
| 5,398,454 | A | 3/1995 | Berner |
| 5,398,457 | A | 3/1995 | Updegrave et al. |
| 5,421,053 | A | 6/1995 | Chodak |
| 5,441,450 | A | 8/1995 | Fein et al. |
| 5,563,482 | A | 10/1996 | Shaw et al. |
| 5,580,302 | A | 12/1996 | Howard, Jr. et al. |
| 5,679,066 | A | 10/1997 | Butz et al. |
| 5,709,595 | A | 1/1998 | Bergner et al. |
| 5,839,949 | A | 11/1998 | Martin et al. |
| 5,885,146 | A | 3/1999 | Cockburn |
| 5,941,891 | A | 8/1999 | Walen |
| 6,004,194 | A | 12/1999 | Hild et al. |
| 6,132,300 | A | 10/2000 | Martin |
| 6,159,084 | A | 12/2000 | Tiede |
| 6,170,579 | B1 | 1/2001 | Wadge |
| 6,176,322 | B1 | 1/2001 | Wadge |
| 6,179,696 | B1 | 1/2001 | Duffy |
| 6,206,107 | B1 | 3/2001 | Wadge |
| 6,244,933 | B1 | 6/2001 | Morkvenas |
| 6,286,611 | B1 | 9/2001 | Bone |
| 6,488,710 | B2 | 12/2002 | Besselink |
| 6,553,642 | B2 | 4/2003 | Driessen |
| 6,613,089 | B1 | 9/2003 | Estes et al. |
| 6,634,439 | B2 | 10/2003 | Driessen |
| 6,675,911 | B2 | 1/2004 | Driessen |
| 6,780,094 | B2 | 8/2004 | Walker |
| 6,875,095 | B2 | 4/2005 | Walker |
| 7,198,559 | B2 | 4/2007 | Walstrum et al. |
| 7,235,005 | B2 | 6/2007 | Schnell et al. |
| 7,270,591 | B2 | 9/2007 | Deshpande et al. |
| 7,371,150 | B2 | 5/2008 | Deshpande et al. |
| 7,713,110 | B2 | 5/2010 | Lampka et al. |
| 8,172,642 | B2 * | 5/2012 | King et al. ..... 451/8 |
| 2003/0097178 | A1 | 5/2003 | Roberson et al. |
| 2003/0130742 | A1 | 7/2003 | Connelly et al. |
| 2004/0220672 | A1 | 11/2004 | Shadduck |
| 2006/0019585 | A1 | 1/2006 | Zayat et al. |
| 2006/0146571 | A1 | 7/2006 | Whitney |
| 2007/0095149 | A1 | 5/2007 | Sieber et al. |
| 2009/0239451 | A1 | 9/2009 | Geiser et al. |

FOREIGN PATENT DOCUMENTS

| | | | |
|---|---|---|---|
| DE | 2748502 | A1 | 5/1979 |
| DE | 2933355 | A1 | 3/1981 |
| DE | 3142749 | A1 | 5/1982 |
| DE | 3538225 | A1 | 4/1987 |
| DE | 19617572 | A1 | 11/1997 |
| EP | 0022222 | A1 | 1/1981 |
| EP | 0033161 | A1 | 8/1981 |
| EP | 0086114 | A1 | 8/1983 |
| EP | 0542667 | A2 | 5/1993 |
| EP | 0610801 | A1 | 8/1994 |
| EP | 0906812 | A2 | 4/1999 |
| EP | 1584412 | A2 | 10/2005 |
| FR | 2568377 | A1 | 1/1986 |
| GB | 2073062 | A | 10/1981 |
| JP | 10286772 | A | 10/1998 |
| WO | WO-2005070624 | A1 | 8/2005 |

* cited by examiner

MULTI-SANDER

CROSS-REFERENCE TO RELATED APPLICATIONS

This application is a continuation of U.S. patent application Ser. No. 12/540,189 filed on Aug. 12, 2009, now U.S. Pat. No. 8,172,642, which claims the benefit of U.S. Provisional Application No. 61/090,417, filed on Aug. 20, 2008. The entire disclosures of the above applications are incorporated herein by reference.

INTRODUCTION

The present disclosure generally relates to a sander having multiple platens that can be selectively attached to a common sander base without the use of a hand tool.

Sanders typically have a platen to which an abrasive media, such as sandpaper, is attached. Sanders with removable, differently shaped platens (e.g., rectangular, square, round) are available to permit the user of the sander to change the platen to one with a shape that is best suited for a given sander task. Such removable platens typically are secured to the sander by way of one or more threaded fasteners (e.g., socket head cap screws). These threaded fasteners require the use of tools (e.g., Allen wrenches) to remove them from the sander to thereby decouple the platen from the sander.

Various tool-less coupling systems have been developed for coupling a platen to the rotating output member of a rotary grinder. Such coupling systems, however are relatively large and costly and do not support an abrasive media in an area where one element of the coupling system is received against the platen.

SUMMARY

This section provides a general summary of the disclosure, and is not a comprehensive disclosure of its full scope or all of its features.

A tool for moving an abrasive media can include a tool body and a drive system housed in the tool body. The drive system can include an output member. A retaining member can be disposed on the tool body. A first platen having a first attachment hub can be selectively coupled with the retaining member in an installed position. The first platen can have a first rotatable member that selectively attaches to the output member in a first mode of operation. A second platen having a second attachment hub can selectively couple with the retaining member in an installed position. The second platen can have a second rotatable member that selectively attaches to the output member in a second mode of operation.

A mode selector can be disposed on the tool body. The mode selector can have a movable member and a key. The movable member can be movable between at least a first position that corresponds to a first output member speed and a second position that corresponds to a second output member speed. The movable member can be substantially aligned with a first zone on the key that corresponds to the first platen in the first position and second zone on the key that corresponds to the second platen in the second position.

According to other features, the first rotatable member of the first platen can be mounted for an orbit having a first offset relative to the output member. The second rotatable member of the second platen can be mounted for an orbit having a second offset relative to the output member. The first and second offsets can be distinct. The first rotatable member can include a first fan having a first counterbalance disposed thereon. The second rotatable member can comprise a second fan having a second counterbalance disposed thereon. The first and second counterbalances can have distinct masses. In one example, the first platen can be an orbital platen configured for orbital sander in the installed position and the second platen can be a random orbit platen configured for random orbit sander in the installed position. The first platen can comprise a plurality of flexible columns having first ends coupled to the first platen and second ends that are selectively retained by the tool body in the installed position.

According to additional features, the retaining member can comprise a wireframe that selectively nests in respective grooves defined around each of the first and second attachment hubs respectively in the installed position. A button can be disposed on the tool body. The button can cooperate with the wireframe and be movable to a release position to spread the wireframe and release the wireframe from the respective grooves to exchange between the first and second platens. According to one example, a chamfered annular leading edge is defined on each of the first and second attachment hubs respectively. Movement of a respective first or second platen to the installed position can cause the annular leading edge to spread the wireframe until continued movement toward the installed position causes the wireframe to nest in the respective grooves.

According to still other features, the tool can include a third platen having a third attachment hub that selectively couples with the retaining member in an installed position. The third platen can have a third rotatable member that selectively attaches to the output member in a third mode of operation. The first platen can define an iron-shaped profile having a substantially flat first end and a substantially pointed second end. The first platen can comprise a dust chute arranged proximate to the substantially pointed second end. The third platen can define an iron-shaped profile having a substantially pointed first end and a substantially flat second end. The third platen can comprise a dust chute arranged proximate to the substantially flat second end. The substantially flat first end of the first platen is aligned with a forward end of the tool in the installed position and the substantially pointed first end of a third platen is aligned with a forward end of the tool in the installed position.

According to still other features, the tool can comprise a speed control switch that communicates with the mode selector. The mode selector can define a rib that cams across an input of the speed control switch upon movement of the mode selector to toggle between the first output member speed and the second output member speed.

A method according to the present teachings can include providing a tool with a tool body, a drive system and a first and second platen. The tool body can have a mode selector including a movable member and a key. The drive system can have an output member. The method further includes, moving the movable member to one of a first position or a second position. The first position can correspond to the first platen and associated with a first output member speed and the second position corresponding to the second platen and associated with a second output member speed. The method can further include, mounting one of the first or second platen to the tool body according to the selected first or second position.

According to additional features, the method can include rotating a dial causing a rib defined on the dial to cam across an input of a speed control switch and change the speed of the output member between a first and second output member speed. According to one example of the method, mounting one of the first or second platens to the tool body can include urging an attachment hub associated with a respective first or second platen into engagement with a wireframe retaining member disposed on the tool body. The method further includes, urging the attachment hub into engagement with the wireframe retaining member, such that the wireframe retaining member rides over a chamfered annular leading edge defined on the attachment hub and spreads outwardly until the wireframe retaining member nests at least partially around the selected attachment hub in a groove defined on the selected attachment hub.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
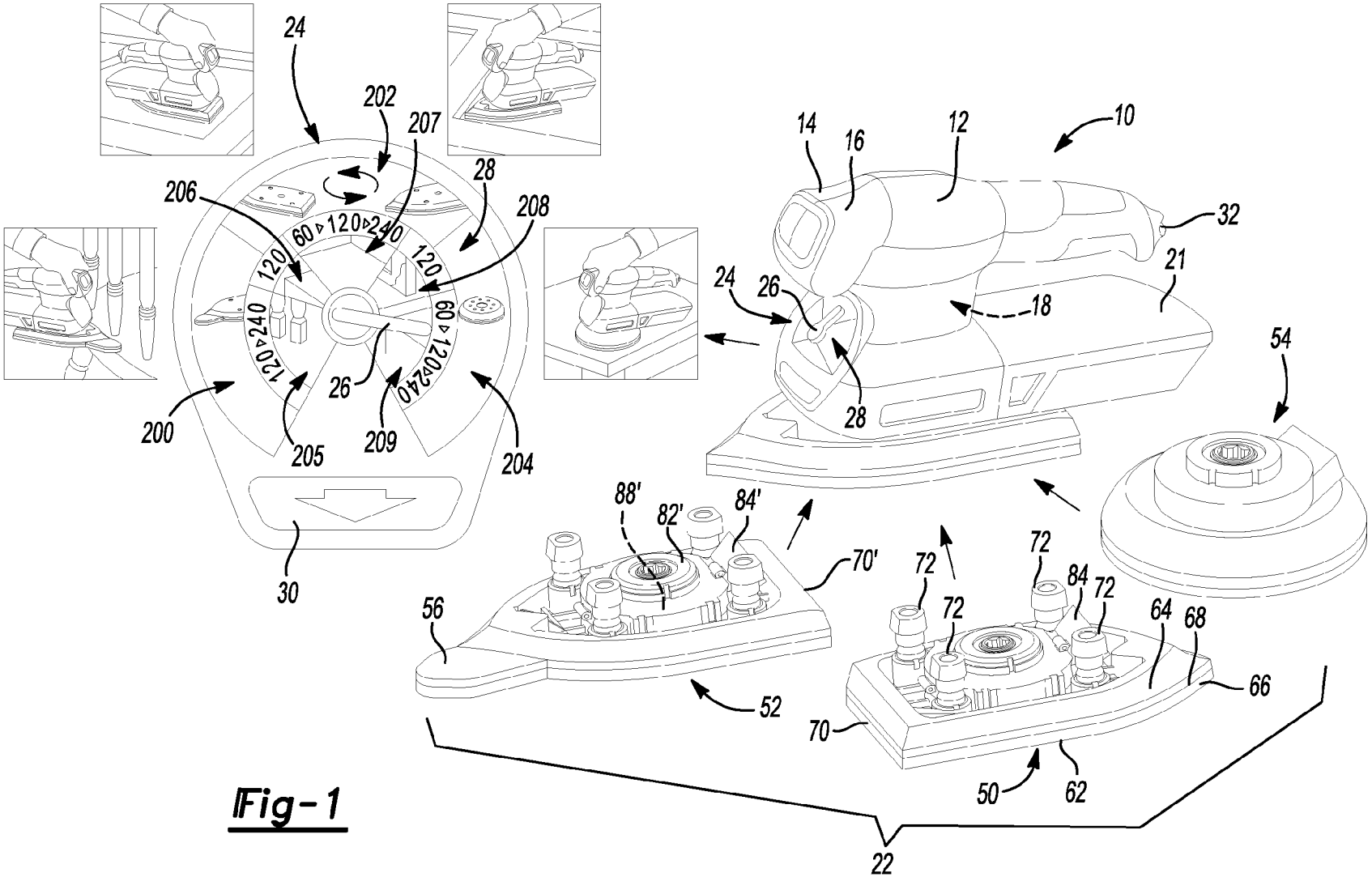
FIG. 1 is a front perspective view of an exemplary sander constructed in accordance to the present teachings and shown operatively associated with a series of sander platens that can be interchangeably secured to the sander, FIG. 1 also including an enlarged plan view of an exemplary mode selector provided on the sander.

Example embodiments will now be described more fully with reference to the accompanying drawings. Corresponding reference numerals indicate corresponding parts throughout the several views of the drawings.

With initial reference to FIGS. 1-5, an exemplary abrasive material removal tool is generally indicated by reference numeral 10. The abrasive material removal tool, hereinafter sander 10, can include a tool body or housing 12 having a pair of clam shell portions 14 and 16. The sander 10 can further include a drive system 18 that is housed in a cavity defined by the clam shell portions 14 and 16. The tool body 12 and the drive system 18 can be conventional in their construction and operation, and as such, need not be discussed in significant detail herein. The tool body 12 can further define a dust extraction port 20 (FIG. 4) to which dust can be extracted to a dust chamber 21. The drive system 18 can selectively couple with a plurality of platens, collectively referred at reference numeral 22 as will be described in greater detail herein.

A mode selector 24 can be arranged on a forward portion of the tool body 12. The mode selector 24 can include a movable member or dial 26 and a pictorial key 28. A base release button 30 can be provided proximate to the mode selector 24. A power cord 32 can extend from the tool body 12 to supply electrical current to the sander 10. It is appreciated that while the sander 10 is shown operatively associated with a power cord 32 for alternating current (AC) operation, the sander 10 can also be configured for operation with other power sources, such as direct current (DC) or a pneumatic input.

The sander 10 will be further described. The drive system 18 can include an electric motor 36 (FIG. 4) mounted within the tool body 12 and having an output member 38. In the exemplary configuration, the output member 38 can define a male spline 40. A fan (not shown) can be mounted on the output member 38 for rotation therewith. The fan can include a plurality of upwardly projecting blades generally arranged to direct air toward the motor 36. In this manner, the upwardly projecting fan blades can operate to generate a cooling air flow when the motor 36 is turned on to help cool the motor 36 during operation of the sander 10. A bearing 44 can radially support the output member 38.

With specific reference now to FIGS. 1-7, the exemplary platens 22 will be described in greater detail. According to the present teachings, each of the plurality of platens 22 can be releasably connected to the tool body 12 without the use of a hand tool (such as a screwdriver, Allen wrench, etc.). The exemplary platens 22 can include a finishing sander platen 50, a detail sander platen 52, and a random orbit sander platen 54. The detail sander platen 52 can include a releasable finger attachment 56 for detail sander. As will be described, the finishing sander platen 50 and detail sander platen 52 are configured for orbital motion while the random orbit sander platen 54 is configured for random orbit motion. U.S. Pat. Nos. 6,132,300 and 5,885,146 provide examples of abrading tools that provide orbital and random orbit motion. These patents are hereby incorporated by reference as is fully set forth in detail herein.

The finishing sander platen 50 can define a substantially flat bottom surface 62, a curved upper surface 64, and a peripheral edge with a point 66 that provides the finishing sander platen 50 with an iron-shape. The point 66 can be used for sander corners or other areas. In one example, an abrasive sheet (not shown) can be applied to the flat bottom surface 62 by way of a hook and loop fabric fastener. An underside of the abrasive sheet can have a first hook and/or loop surface, which can be attachable to a second hook and/or loop surface (not shown) provided on the flat bottom surface 62 of the finishing sander platen 50.

According to one example, a portion 68 of the finishing sander platen 50, adjacent to the point 66 of the peripheral edge, can be detachable from the remainder of the finishing sander platen 50. The detachable portion 68 can be loosened or completely detached from the finishing sander platen 50 and rotated through 180°, or even replaced, as the edges on either side of the point become worn. Further details of the detachable portion 68 can be found in commonly owned U.S. Pat. No. 5,839,949, which is hereby incorporated by reference as if fully set forth in detail herein. As can be appreciated, the finger attachment portion 56 of the detail sander platen 52 can occupy the space of an otherwise located point 66 (i.e., see finishing sander platen 50). Those skilled in the art will readily appreciate that the shape and configuration of the finishing sander platen 50 and detail sander platen 52 are substantially equivalent, the finishing sander platen 50 being configured for mounting to the tool body 12 with a flat forward end 70 facing toward the front of the sander 10, whereas the detail sander platen 52, having the finger attachment 56, can be secured to the tool body 12 having the finger attachment 56 being oriented toward the forward end of the sander 10. Those skilled in the art will also appreciate that the detail sander platen 52 can also be mounted to the sander 10 without the finger attachment 56.

Figure 2:
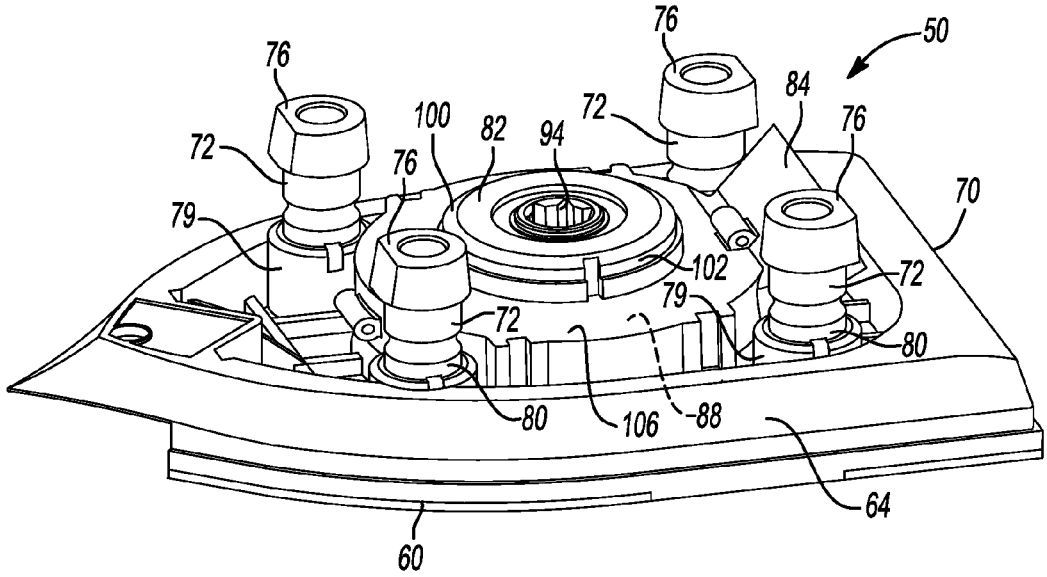
FIG. 2 is a side perspective view of an exemplary finishing sander platen.
Figure 4:
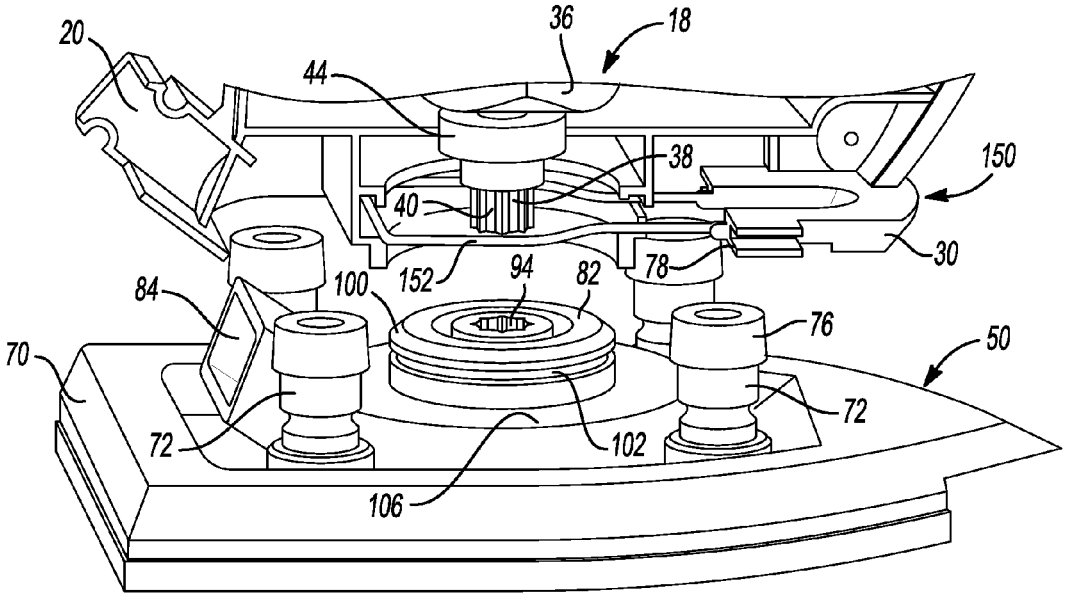
FIG. 4 is a partial cut-away view of the sander and shown with the detail sander platen aligned prior to engagement with the tool body of the sander.

With specific reference to FIGS. 2 and 4, the finishing sander platen 50 can further define a plurality of elastomeric legs 72. In the example shown, four elastomeric legs 72 are used, one pair toward the front of the sander 10 and another pair disposed toward the rear of the sander 10. First ends 76 of the elastomeric legs 72 can be selectively received by mounting hubs 78 defined in the front and rear clam shell portions 14, 16. Second ends 80 of the elastomeric legs 72 can be fixedly secured to the finishing sander platen 50 by mounting bosses 79. Other configurations may be employed for securing the elastomeric legs 72 between the tool body 12 and the finishing sander platen 50.

Figure 6:
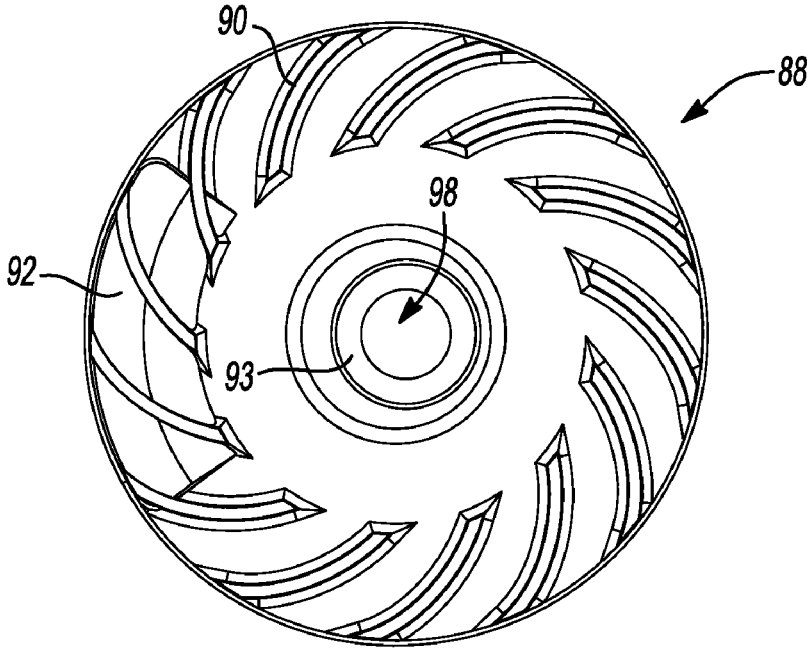
FIG. 6 is an exemplary plan view of a rotatable member having a fan and a counterweight and constructed in accordance to one example of the present teachings.

The finishing sander platen 50 can further define a centrally located attachment hub 82 and a chute 84. The attachment hub 82 can generally house a rotatable member 88 (FIG. 6). The rotatable member 88 can generally be in the form of a fan 90 having a counterweight 92. The fan 90 can be configured to direct air through the chute 84 and into the dust extraction port 20. The rotatable member 88 can define a mounting hub 93 that aligns for rotation with a female spline 94 that cooperatively receives the male spline 40 of the output member 38 in an installed position. The mounting hub 93 can be offset from a central axis 98 of the rotatable member 88. As can be appreciated, the offset can be any suitable distance to provide an orbital motion of the finishing sander platen 50 during operation. In one example, the offset can be 2 mm. Other configurations are contemplated. For example, other finishing sander platens may be provided having other offsets.

With reference again to FIGS. 2 and 4, the attachment hub 82 can define a chamfered annular leading edge 100. The attachment hub 82 can further define a groove 102 defined around a cylindrical outboard surface 104. A shroud 106 can be defined on the finishing sander platen 50. The shroud 106 can generally surround the rotatable member 88. In one example, the attachment hub 82, the chute 84 and the shroud 106 can be monolithic or integrally formed.

As can be appreciated, the detail sander platen 52 can be constructed similarly to the finishing sander platen 50. Therefore, a detailed description of the detail sander platen 52 will not be repeated. As illustrated, however, a chute 84' (FIG. 1) can be arranged proximate to its rearward end (i.e., its flat end 70') for cooperatively aligning with the dust extraction port 20 provided in the tool body 12. An attachment hub 82' can house a rotatable member 88' (FIG. 1).

Figure 3:
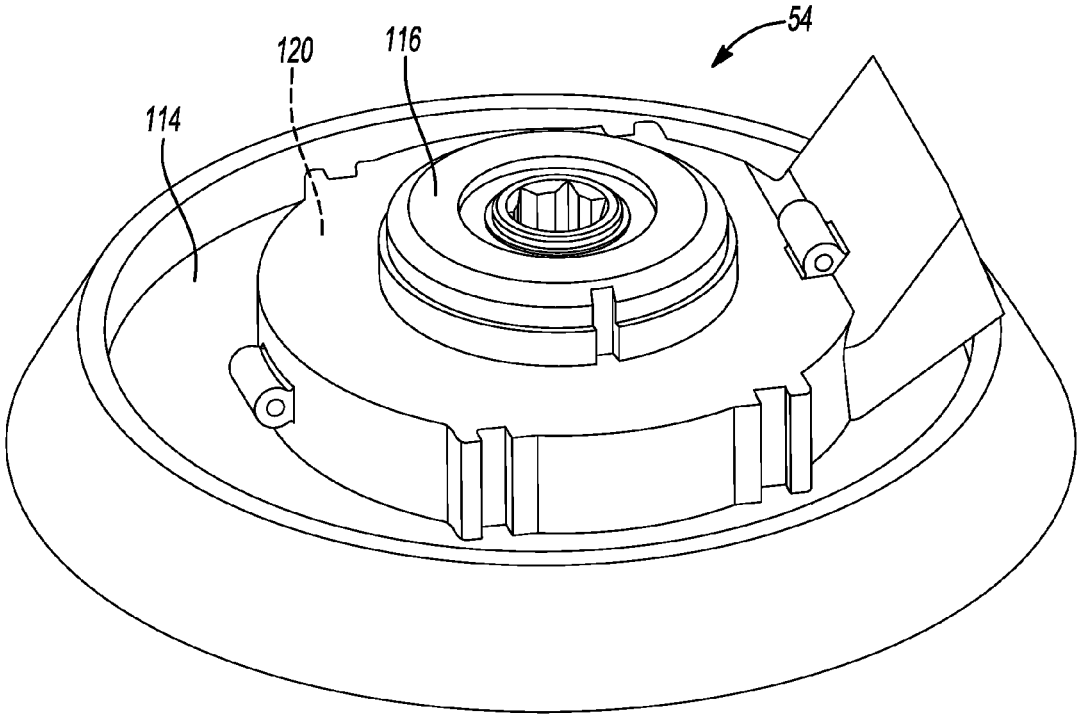
FIG. 3 is a side perspective view of an exemplary random orbit sander platen.
Figure 7:
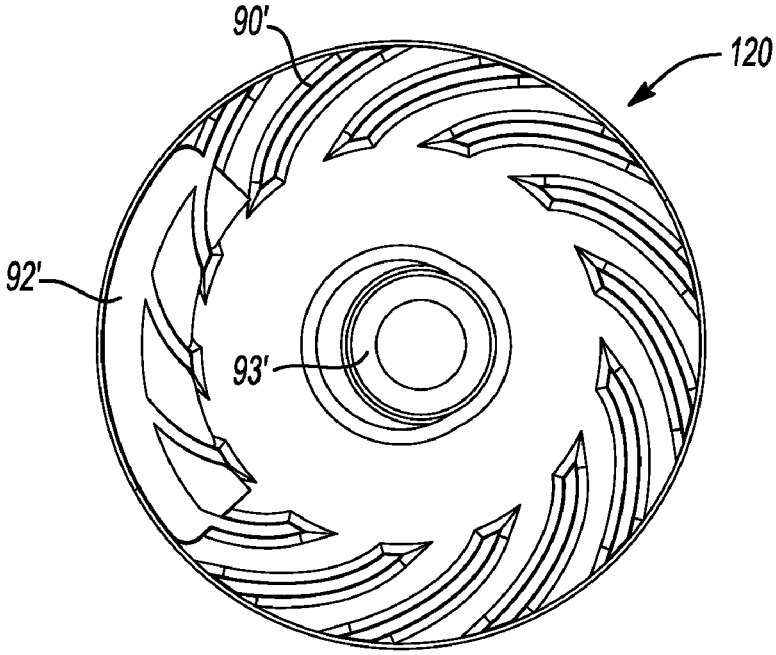
FIG. 7 is a plan view of another rotatable member including a fan and a counterweight constructed in accordance to additional features of the present disclosure.

With specific attention now to FIGS. 3 and 7, the random orbit sander platen 54 can generally define a circular platen body 114 having an attachment hub 116. Those skilled in the art will recognize that the random orbit sander platen 54 is not constrained outboard of the attachment hub 116 (i.e., such as with elastomeric legs) allowing a random orbit sander 54 to move in a motion during use. The attachment hub 116 can be formed generally equivalent to the attachment hub 82 described above with respect to the finishing sander platen 50. Housed within the attachment hub 116 is a rotatable member 120 (FIG. 7). The rotatable member 120 can define a similar mounting hub 93', fan 90' and counterweight 92' arrangement as described above with respect to the fan 90, counterweight 92 and mounting hub 93. The rotatable member 120, however, can define a distinct offset (e.g. the mounting hub can be offset from its central axis) as compared to the orbit sander platens 50 and 52, described above. In one example, the offset can be about 4 mm. In another example, the offset can be 2 mm and the orbit can be 4 mm. It is appreciated, however, that each of the platens 22 can define mounting hubs (i.e., 93) that have an offset relative to a central axis of the rotatable member (i.e., 88) for providing a desired offset according to a given application. It is also appreciated that each of the counterweights (i.e., 92) can be provided with a mass that is specific to a given platen (i.e., 50, 52 or 54).

Figure 8:
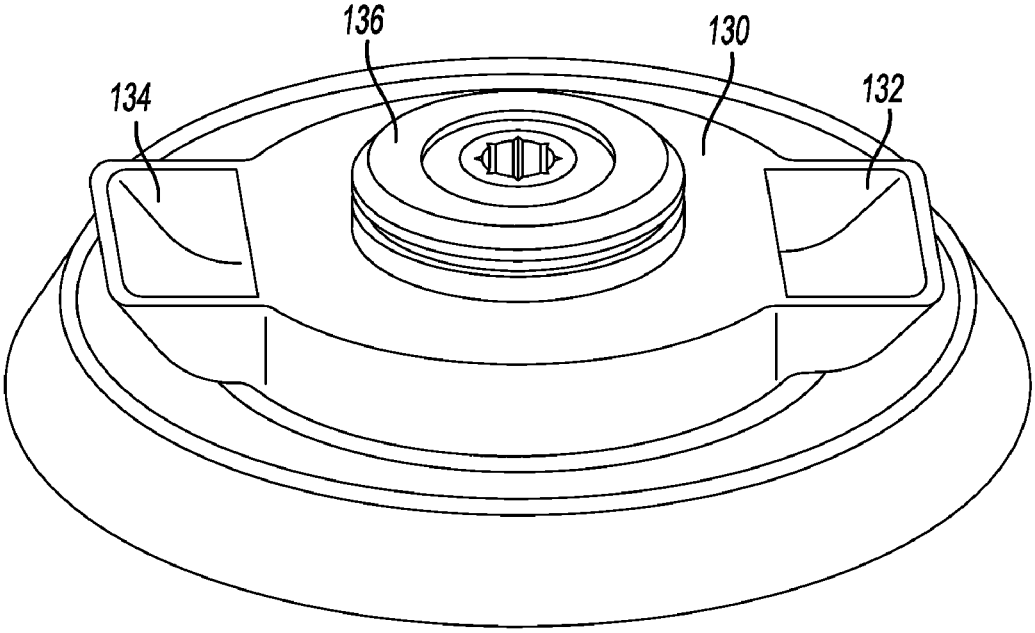
FIG. 8 is a side perspective view of an exemplary random orbit sander platen and shown with a dual-outlet shroud according to one example of the present disclosure.
Figure 9:
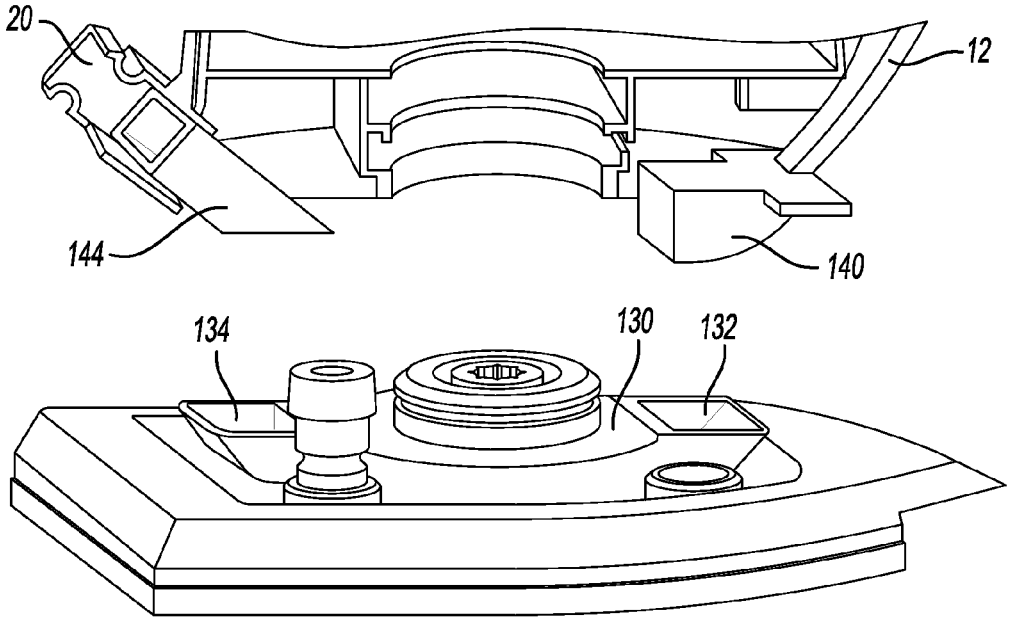
FIG. 9 is a partial cut-away view of the tool body of the sander and shown prior to engagement with a platen having the dual shroud.
Figure 10:
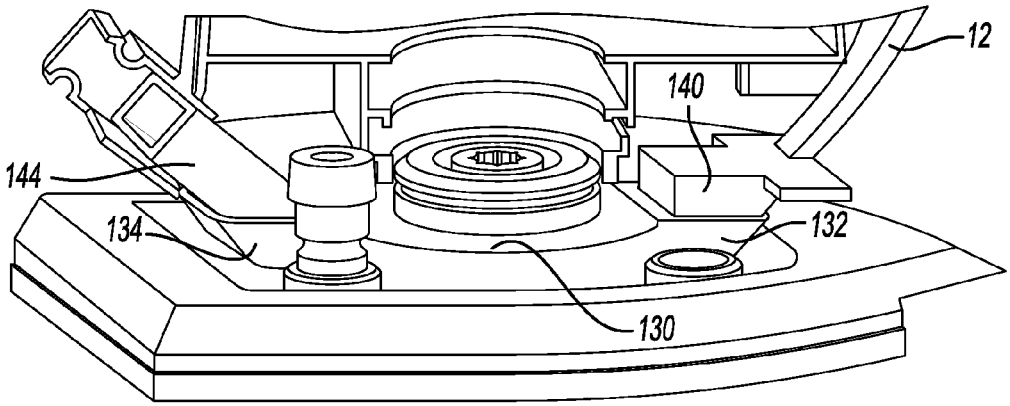
FIG. 10 is an assembled view of an exemplary sander platen having the dual-outlet shroud and connected to the tool body of the sander, wherein one of the outlets is aligned for coupling with a plug and the other outlet is aligned for communicating air through a dust extraction port formed in the tool body.

Turning now to FIGS. 8-10, a shroud 130 constructed in accordance to another example is shown. The shroud 130 includes a first chute 132 and a second chute 134 formed thereon. The shroud 130 can be integrally formed with an attachment hub 136. The attachment hub 136 can be formed equivalently to the attachment hubs 82 and 116 described above. Those skilled in the art will recognize that the shroud 130, having first and second chutes 132 and 134, can operatively align with the dust extraction port 20 in either a forward mounted position (i.e., the pointed end aligned with the front of the sander 10 for an iron-shaped platen) or a rearward mounted position (i.e., the flat end arranged toward the front of the sander 10). In one example, a plug 140 can be provided in the tool body 12 for aligning with an unused chute 132, 134. In one example, the plug 140 can be formed of a compliant material and be generally captured by one of, or both of the clam shell housings 14, 16. According to one example, a dust chute connector 144 can be interposed between the functioning chute 132 or 134 and the dust extraction port 20. It is appreciated that the shroud 130 can be adapted for use with any of the platens 22 disclosed herein. For example, the shroud 130 is shown in FIG. 8 operatively associated with a circular random orbit sander platen, whereas the shroud 130 is shown in FIGS. 9 and 10 cooperatively with an iron-shaped finishing sander platen.

Figure 5:
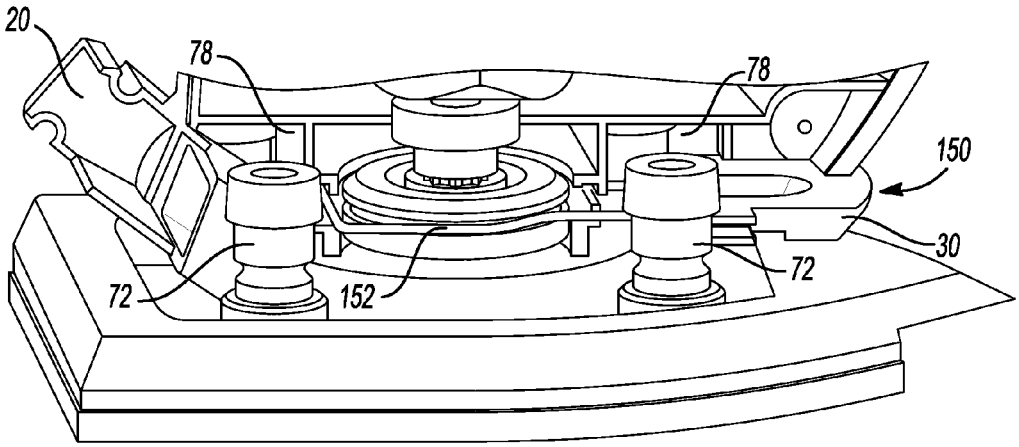
FIG. 5 is a partial cut-away view of the sander of FIG. 4 and shown with the detail sander platen selectively coupled to the tool body of the sander.

With renewed reference now to FIGS. 4 and 5, the sander 10 can include an attachment assembly 150 for releasably coupling the respective sander platens 22 to the tool body 12. The attachment assembly 150 can generally include the button 30, a retaining member or wireframe 152 and a spreader block 154. In the exemplary embodiment, the retaining member 152 is in the form of a wireframe. However, other configurations are contemplated. In general, the wireframe 152 can selectively nest with the groove (i.e., groove 102) of a respective attachment hub (i.e., attachment hub 82).

Figure 11:
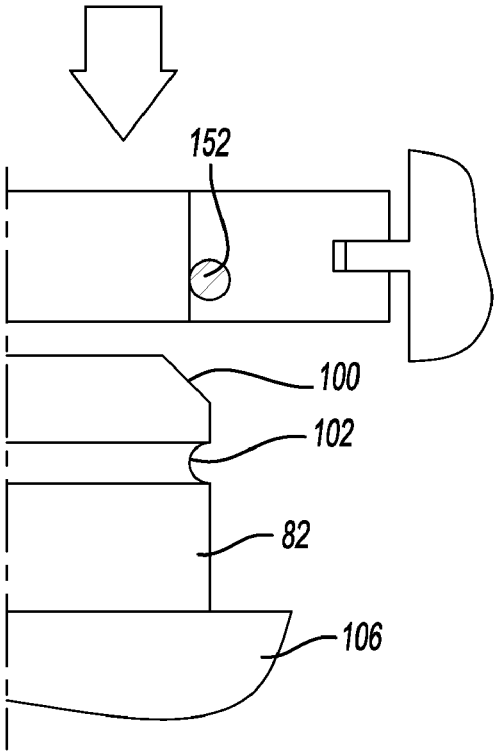
FIGS. 11-14 illustrate an exemplary assembly sequence wherein an attachment assembly selectively couples with an attachment hub provided on an exemplary sander platen.
Figure 12:
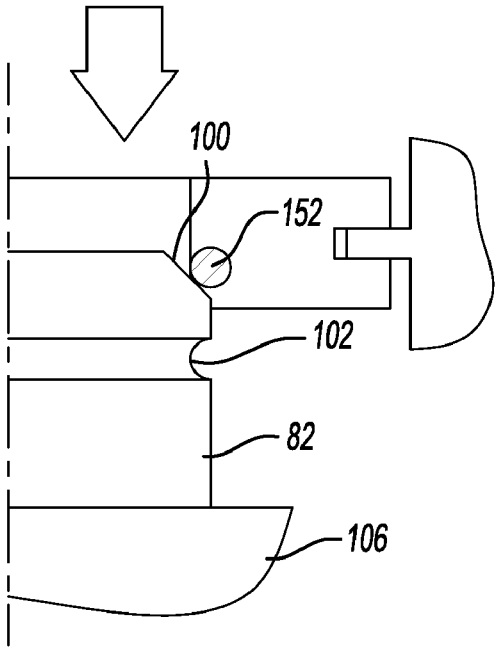
Figure 13:
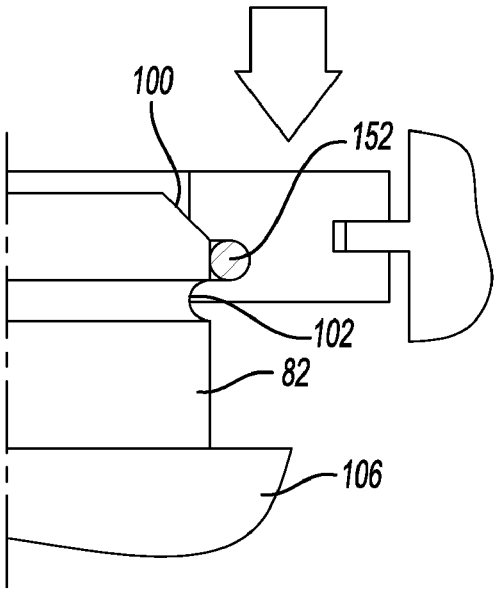
Figure 14:
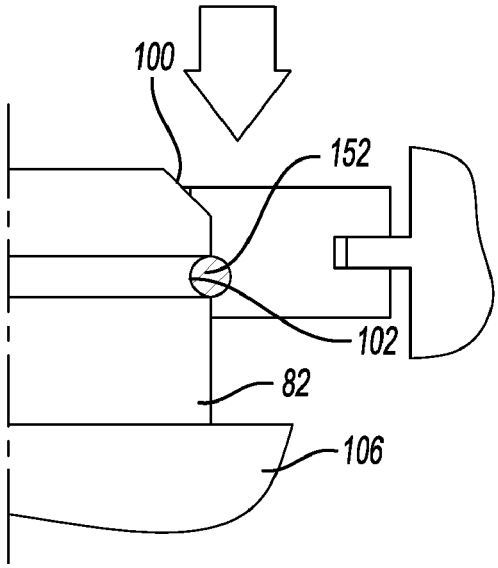
Figure 15:
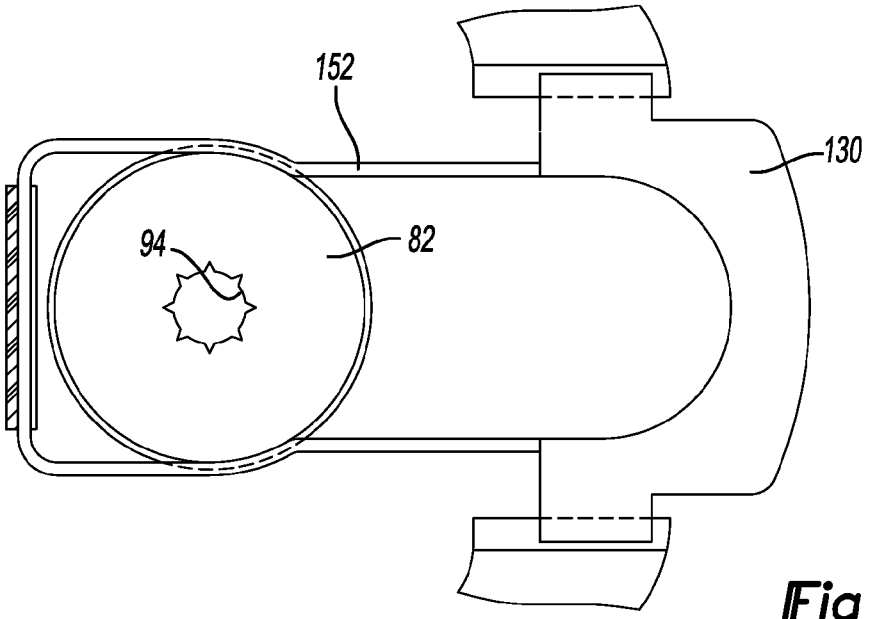
FIGS. 15 and 16 illustrate an exemplary sequence of releasing a sander platen from the tool body wherein a button of the attachment assembly is actuated causing a wireframe to spread and therefore release from engagement with a groove defined on the attachment hub.
Figure 16:
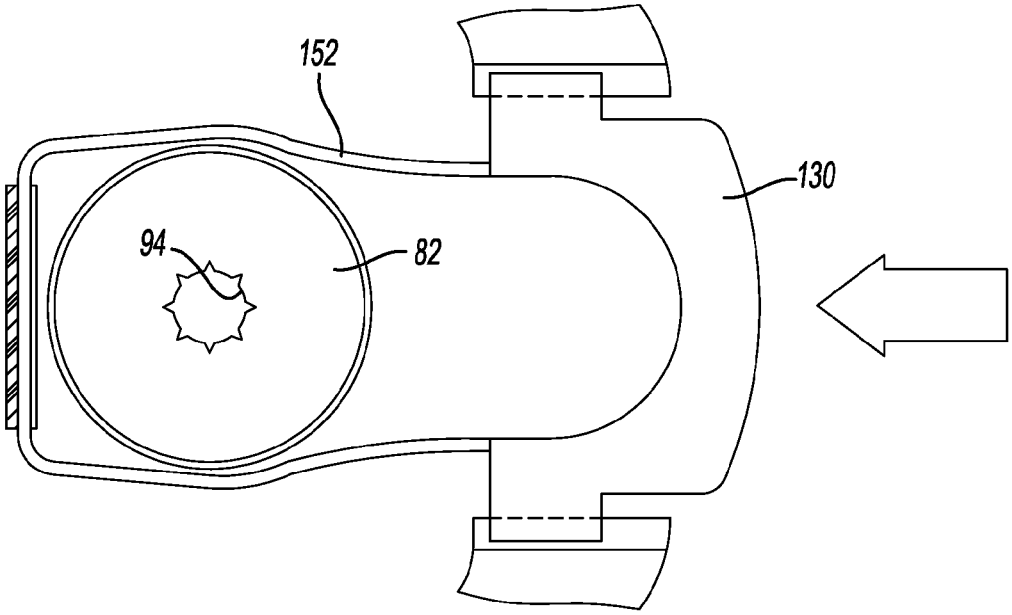
Figure 17:
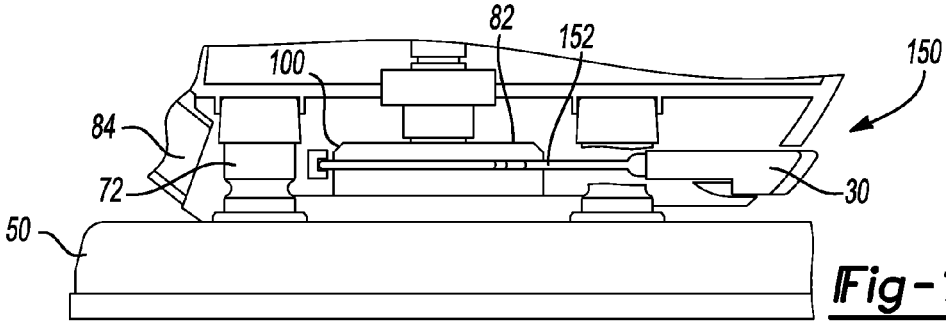
FIGS. 17-19 illustrate an exemplary sequence of releasing a sander platen from the tool body wherein the button is actuated causing release of the wireframe from the groove defined in the attachment hub.
Figure 18:
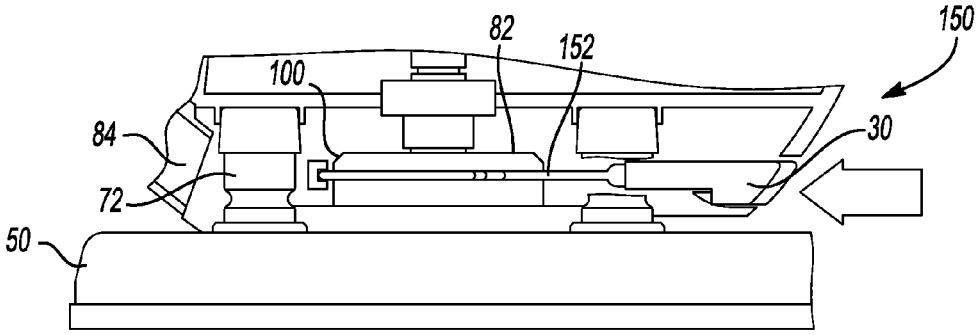
Figure 19:
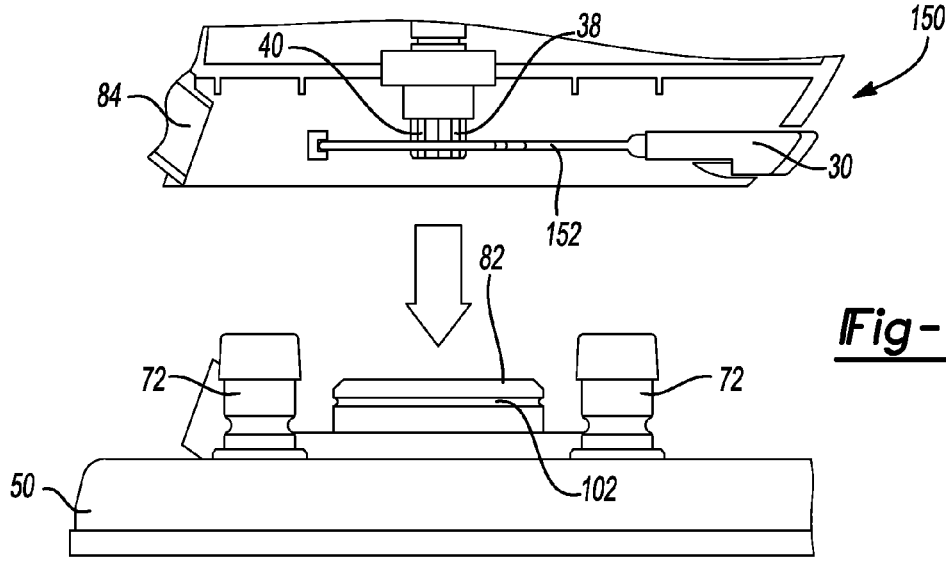
Figure 20:
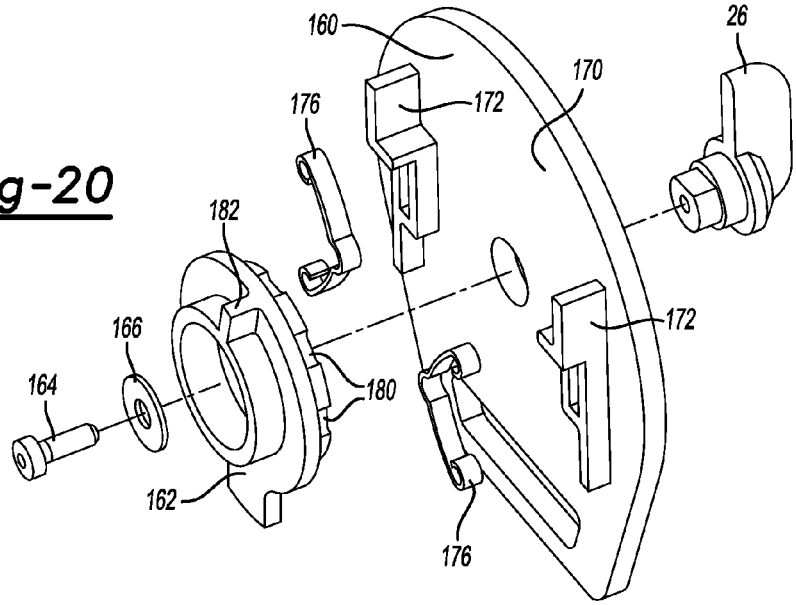
FIG. 20 is an exploded perspective view of the mode selector of FIG. 1.
Figure 21:
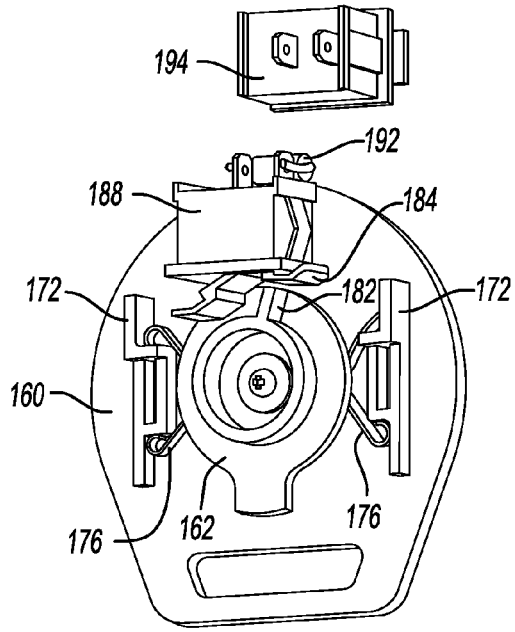
FIG. 21 is a rear perspective view of a control panel of the mode selector of FIG. 20 and shown cooperating with a speed control switch.
Figure 22:
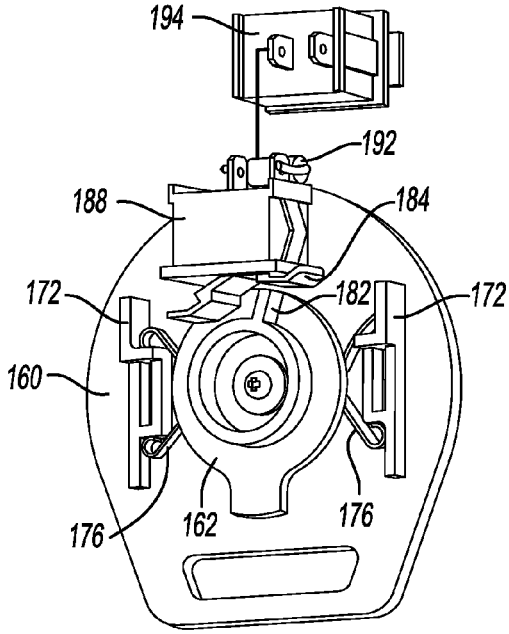
FIG. 22 is a rear perspective view of the control panel of FIG. 21 and shown with the speed control switch and electrical communication with an on/off switch.

As mentioned above, the attachment assembly 150 can selectively couple with an identified sander platen 22 without the use of a hand tool (such as a screwdriver or Allen key, etc.). An exemplary method of attaching the finishing sander platen 50 according to one example of the present teachings will now be described with reference to FIGS. 4, 5 and 11-19. It is appreciated that attaching (and removing) other platens (i.e., 52 or 54) will be carried out similarly. At the outset, a user can generally align the female spline 94 of the rotatable member 88 with the male spline 40 of the output member 38 (FIG. 4). Concurrently, a user can align the first ends 76 of the legs 72 with the respective hubs 78 defined in the tool body 12. The user can then urge the tool body 12 downwardly (and/or the finishing sander platen 50 in a direction upward) as viewed in FIG. 11. During such motion, the wireframe 152 can slidably urge over the chamfered annular leading edge 100 of the attachment hub 82 causing the wireframe 152 to generally spread outwardly until the wireframe 152 "snaps" into the groove 102 (see sequence of FIGS. 11-14). Those skilled in the art will appreciate that the wireframe 152 can have spring-like characteristics, such that in its relaxed state, the wireframe 152 can occupy a nested position within the groove 102 and therefore retain a respective sander platen 22. In one example, the wireframe 152 can be formed of a metallic material. Those skilled in the art will appreciate that the attachment assembly 150 and/or the wireframe 152 can be configured differently. During the advancement of the attachment hub 82 toward the tool body 12, the first ends 76 of the legs 72 can nest into the respective hubs 78 defined in the tool body 12.

An exemplary method of releasing the finishing sander platen 50 according to the present teachings will now be described. Again, it is appreciated that releasing other platens (i.e., 52 or 54) will be carried out similarly. A user can push the base release button 30 inwardly (i.e., in a direction leftward as viewed in FIG. 16). Movement of the base release button 30 in a direction leftward (i.e., into the tool body 12) can cause the button to slide along the wireframe 152 and therefore urge an intermediate portion of the wireframe 152 to spread radially out of engagement with the groove 102. With the wireframe 152 in a position clear from the groove 102 (FIGS. 16 and 19), a user can then pull the finishing sander platen 50 in a direction downward (i.e., in a direction along an axis defined by the female spline 94) and away from the tool body 12.

With reference now to FIGS. 1 and 20-22, the mode selector 24 will be described in greater detail. The mode selector 24 can generally define a control panel 160 that rotatably supports the movable member 26 to a backing plate 162 by way of a threaded fastener 164 and washer 166. A rear face 170 of the control panel 160 can define a pair of supports 172 that mount a pair of detent springs 176, respectively. The backing plate 162 can define a plurality of depressions 180 formed around its annular surface. As will be described, the detent springs 176 can selectively nest within an aligned pair of depressions 180 to positively locate the movable member 26 at a desired operating location. The backing plate 162 can further define a rib 182. The rib 182 can be aligned with a toggle bar 184 associated with a speed control switch 188. According to one example, the toggle bar 184 can toggle between a first and second position upon movement of the rib 182 across the toggle bar 184. As will be described, the first and second position can correspond to a first and second speed of the motor 36 (and therefore the output member 38).

An exemplary circuit associated with the mode selector 24 will be described briefly. The speed control switch 188 can include a diode 192. The speed control switch 188 can be electrically connected to an on/off switch 194 of the sander 10. In one example, when the speed control switch 188 is moved to the first or "on" position, current bypasses the diode 192 and the sander 10 runs at full speed. When the speed control switch 188 is turned to the second or "off" position, the current is forced through the diode 192 and the voltage is dropped causing the motor 36 (and, as a result, the output member 38 to rotate at a reduced speed).

With reference again to FIG. 1, the pictorial key 28 of the mode selector 24 will be described in greater detail. As shown, the pictorial key 28 can have a first outer zone 200, a second outer zone 202, and a third outer zone 204. In one example, each of the first, second and third outer zones 200, 202, and 204 can include graphical information, such as photos and/or sketches that correspond to a given sander task. As illustrated, the first outer zone 200 can include a graphic with a pictorial representation of the detail sander platen 52. The second outer zone 202 can have a graphical representation of the finishing sander platen 50. The third outer zone 204 can have a graphical representation of the random orbit sander platen 54. In one example, each of the outer zones can be color-coded with a distinct color. In addition, a picture of a turtle can be provided on the first outer zone 200 and a picture of a rabbit can be provided on the third outer zone 204. As can be appreciated, a rotational orientation of the movable member 26 pointing toward the third outer zone 204 can correspond with the first speed and with the toggle bar 184 in the first position, such that the speed control switch 188 is in the "on" position. Likewise, when the movable member 26 rotated to be pointed toward the first outer zone 200, the toggle bar 184 is toggled to the second position (via movement of the rib 182 across the toggle bar 184) corresponding to the speed control switch 188 in the "off" position. It is appreciated that additional speed settings may be provided according to the outer zones and/or the inner zones (described below). It is contemplated that a potentiometer could be implemented to control speed.

According to other examples, indicia can be arranged around the pictorial key 28 that correspond to a grit value of sand paper optimized for a given task. Additionally or alternatively, the pictorial key 28 can have a graphic (e.g. picture, sketch, photograph, etc.) that corresponds to an exemplary article for sander (i.e., a door, a table, a pedestal, etc.). The grit value and picture of the article to be sanded can be arranged as a first inner zone 205, a second inner zone 206, a third inner zone 207, a fourth inner zone 208 and a fifth inner zone 209. It can be appreciated that while the mode selector 24 has been shown and described above in connection to a movable member 26 that rotates around an axis in the form of a dial or pointer, the mode selector can take alternate forms. For example, the mode selector 24 can alternatively comprise a lever configured for linear movement or other configurations.

Figure 23:
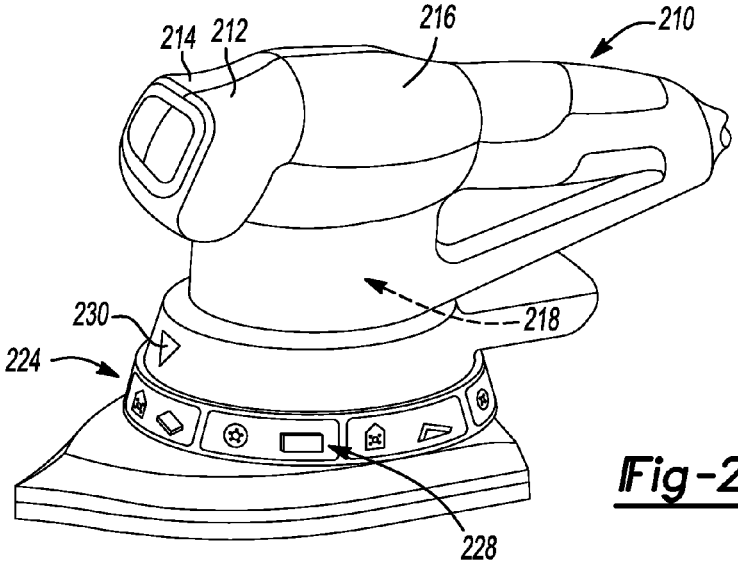
FIG. 23 is a side perspective view of a sander constructed in accordance to additional features of the present teachings.
Figure 24:
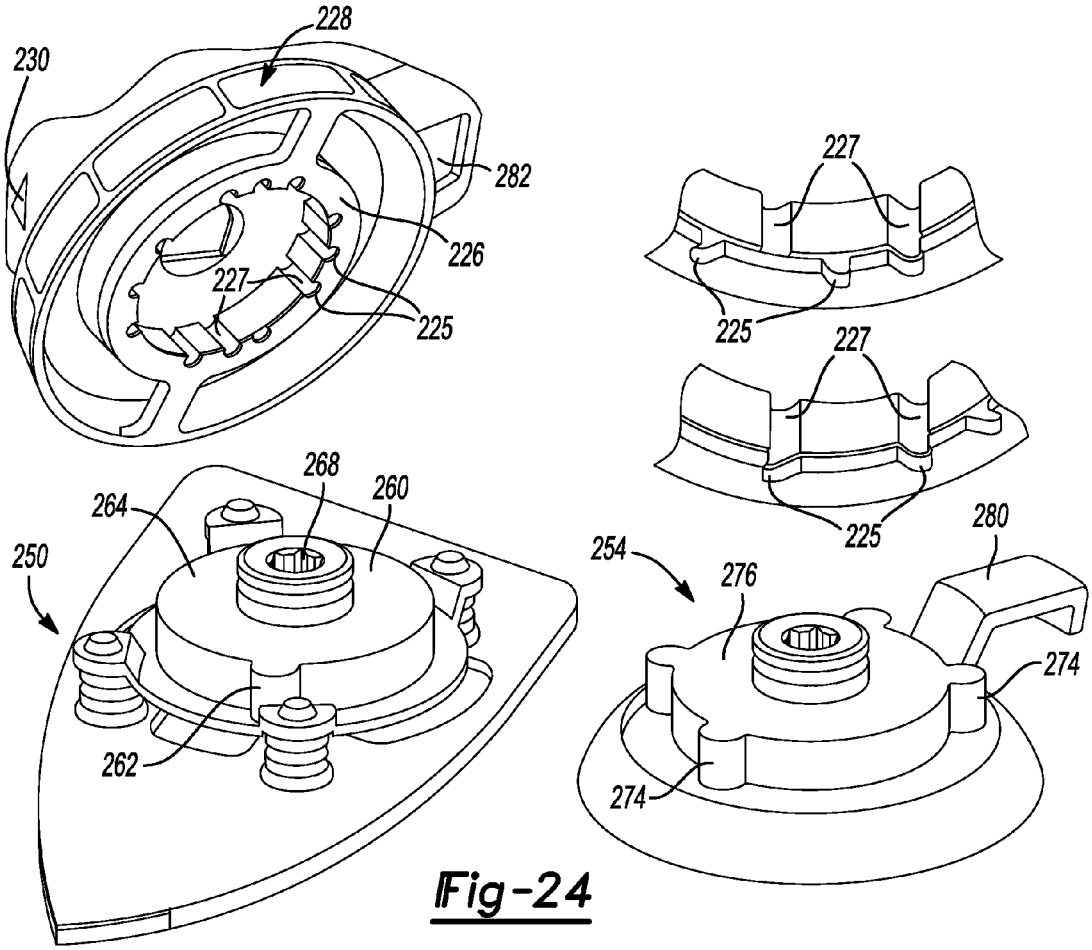
FIG. 24 is a front perspective view of a pair of exemplary sander platens that include nubs that selectively communicate with a first and second plurality of notches provided on the sander for coupling a desired platen to the tool body of the sander.

With reference now to FIGS. 23 and 24, a sander 210 constructed in accordance to another example of the present teachings is shown. Except as otherwise described, the sander 210 can comprise the features as discussed herein with respect to other sanders. The sander 210 can generally include a tool body or housing 212 having a pair of clam shell portions 214 and 216. The sander 210 can further include a drive system 218 that is housed in a cavity defined by the clam shell portions 214 and 216. The tool body 212 and the drive system 218 can be conventional in their construction and operation, and as such, need not be discussed in significant detail herein. A mode selector 224 can be rotatably coupled to the tool body 212. As with the tool 10 described above, the sander 210 can be configured for selectively mating with a plurality of platens 222. An underside of the mode selector 224 can define a first plurality of notches 225 formed around an annular ring 226. The first plurality of notches 225 can cooperatively align with a second plurality of notches 227 defined in the tool body 212. The mode selector 224 can further define a pictorial key 228 arranged therearound. The pictorial key 228 can define similar graphical representations as described above with respect to the pictorial key 28. In the mode selector 224, according to this example, however, the pictorial key 228 of the mode selector 224 is rotated to align with an arrow 230 provided on the tool body 212.

The plurality of platens 222 can define a finishing sander platen 250 and a random orbit sander platen 254. Other platens may be provided. The detail sander platen 252 can define an attachment hub 260 that includes a series of nubs 262 extending outwardly around a shroud 264 thereof. A female spline 268 can be provided on the finishing sander platen 250 and be configured for meshingly engaging a male spline 270 provided on an electric motor 272 of the drive system 218. The nubs 262 are configured for slidably aligning and inserting into corresponding first and second notches 225 and 227 defined on the ring 226 of the mode selector 224 and the tool body 212, respectively. As can be appreciated, the first plurality of notches 225 will be rotationally aligned with specific second plurality of notches 227 for accepting the correct platen 222 that corresponds with a given graphic provided on the pictorial key 228 aligning with the arrow 230.

The random orbit sander platen 254 can include nubs 274 arranged around an attachment hub 276. A tongue 280 can extend outwardly adjacent from the attachment hub 276. The tongue 280 can be configured to cooperatively nest in a pocket 282 formed on the tool body 212. As illustrated, the nubs 274 are located at a radially distinct location around the attachment of 276 as compared to the nubs 262 arranged around the attachment hub 260. As can be appreciated, once a user rotates the mode selector 224 to a location in which a graphic of the pictorial key 228 that illustrates the random orbit sander platen 254 is aligned with the arrow 230, the nubs 274 cooperatively align with predetermined notches 225 (of the ring 226 of the mode selector 224) and notches 227 (of the tool body 212). As can be appreciated, the rotational orientation of the notches 225, 227 will permit attachment with only the sander platen 222 identified in the pictorial key 228 aligned with the arrow 230. Therefore, attachment of other sander platens 222 is precluded.

It is appreciated that while the above embodiment has been described in association with "notches" and "nubs" other geometries may be provided for selectively keying specific platens to the tool body 212.

While not specifically shown, a rotatable member can be provided in the respective attachment hubs 260 and 276 that can be configured to provide a desired offset and/or counterbalance mass according to a given task. Also, while not specifically shown, the platens 222 can be selectively coupled to the sander 210, such as by way of an attachment assembly (see attachment assembly 150 described above), or other methods of attachment.

Figure 25:
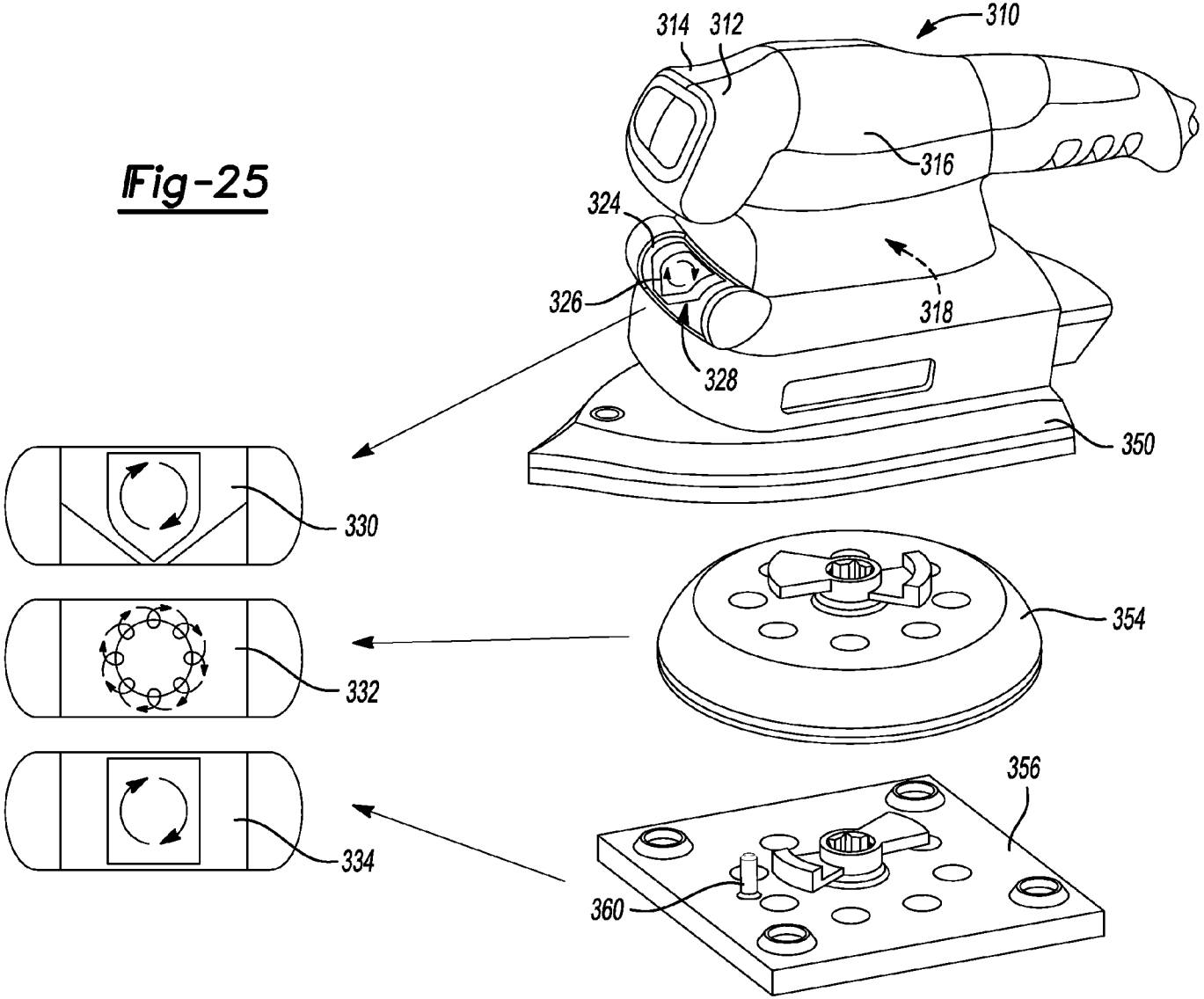
FIG. 25 is a front perspective view of a sander constructed in accordance to additional features of the present teachings and shown operatively associated with a series of exemplary sander platens.
Figure 26:
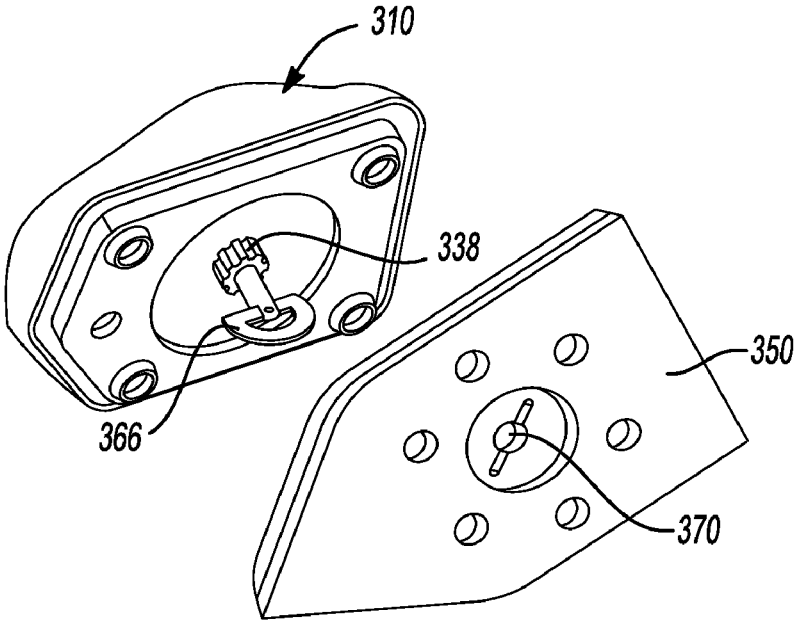
FIG. 26 is a bottom perspective view of the sander of FIG. 25 and shown with an exemplary key for selectively attaching a desired platen to the tool body.

Turning now to FIGS. 25 and 26, a sander 310 according to another example, of the present teachings is shown. Except as otherwise described, the sander 310 can comprise the features as described in herein with respect to other sanders. The sander 310 can include a tool body or housing 312 having a pair of clam shell portions 314 and 316. The sander 310 can further include a drive system 318 that is housed in a cavity defined by the clam shell portions 314 and 316. The tool body 312 and the drive system 318 can be conventional in their construction and operation, and as such, need not be discussed in significant detail herein. The drive system 318 can selectively couple with a plurality of platens, collectively referred to a reference 322. The sander 310 can include a window 324 that provides viewing access to a wheel 326. In one configuration, the wheel 326 can define a pictorial key 328. The pictorial key 328 can include a first zone 330, a second zone 332, and a third zone 334. The respective zones 330, 332 and 334 can correspond to a graphic (i.e., picture, sketch) that illustrates the shape of a given platen 322 as well as a directional path that such given platen 322 will operate in.

The platens 322 can include a finishing sander platen 350, a random orbit sander platen 354, and a square footprint detail sander platen 356. According to one example, a finger, or other structure 360, such as shown on the detail sander platen 356 can be provided for rotating the wheels 326 into a rotational position that corresponds to the zone (i.e., 330, 332, or 334) associated with the attached platen 322 being viewed through the window 324. In one example, a flip key 366 can extend from the output member 338 of the sander 310. The flip key 366 can pass through the corresponding opening 370, shown on the finishing sander platen 350 and rotated to a secured position to lock a given platen 322 relative to the tool body 312. While not specifically shown, a similar opening is defined on the other platens 354 and 356. The flip key 366 can also be provided on other sanders disclosed herein for securing other platens described herein.

Figure 27:
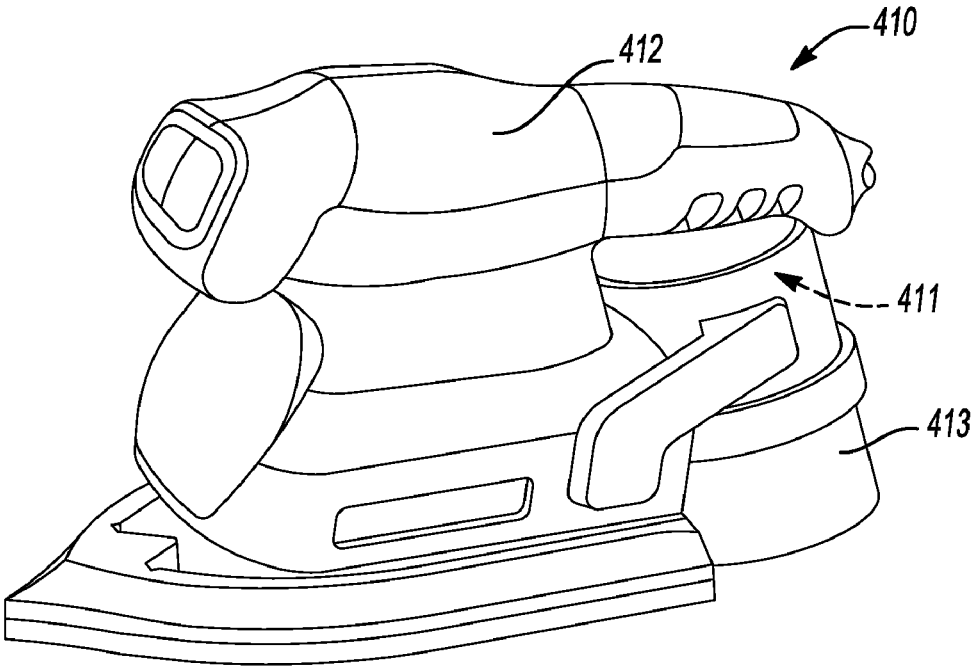
FIG. 27 is a front perspective view of a sander constructed in accordance to additional features of the present teachings and including a dust collection canister.

Turning now to FIG. 27, a sander 410 according to additional features of the present teachings is shown. Except as otherwise described, the sander 410 can comprise the features as described herein with respect to other sanders. The sander 410 can be constructed similar to the sanders 10, 210 and 310 described above and also include a dust extraction fan 411 provided in a canister 413 of the tool body 412. Because a dust extraction fan 411 is provided in a canister 413, a plurality of platens (i.e., such as 350, 354 and 356, FIG. 25) can include rotatable members tuned for each platen. As such, each rotatable member can define a counterweight mass and offset, but without a fan (i.e., the fan 90 described above in relation with the sander 10).

Figure 28:
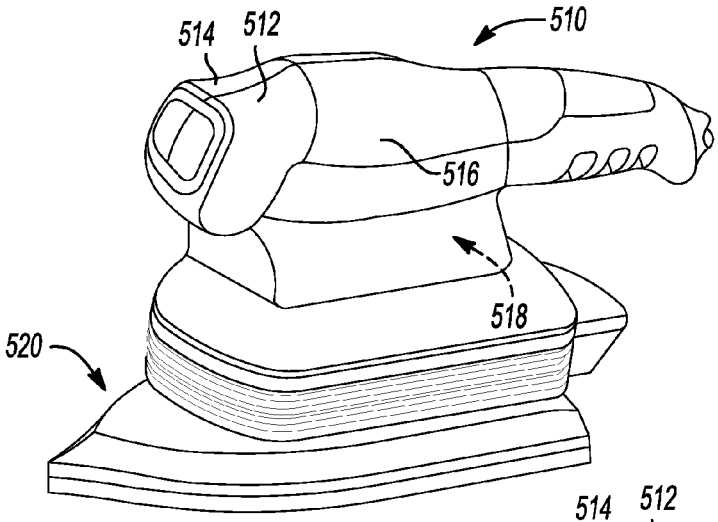
FIGS. 28-30 are front perspective views of sanders constructed in accordance to additional features of the present disclosure and including elastomeric bellows.
Figure 29:
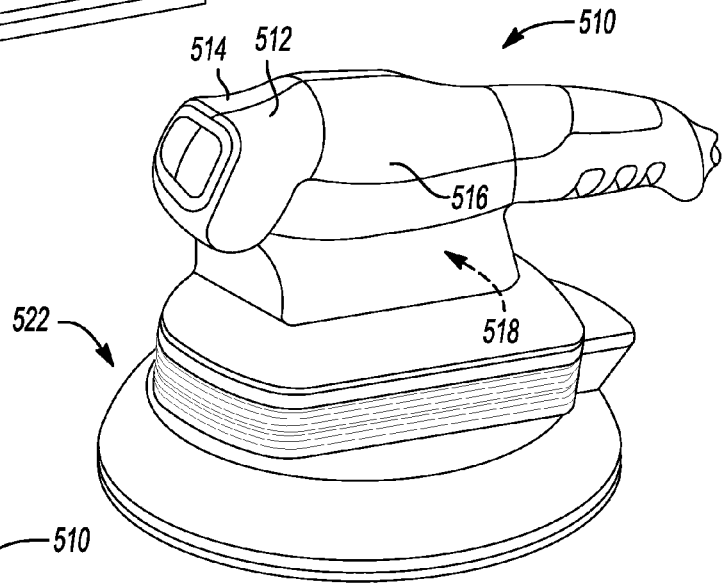
Figure 30:
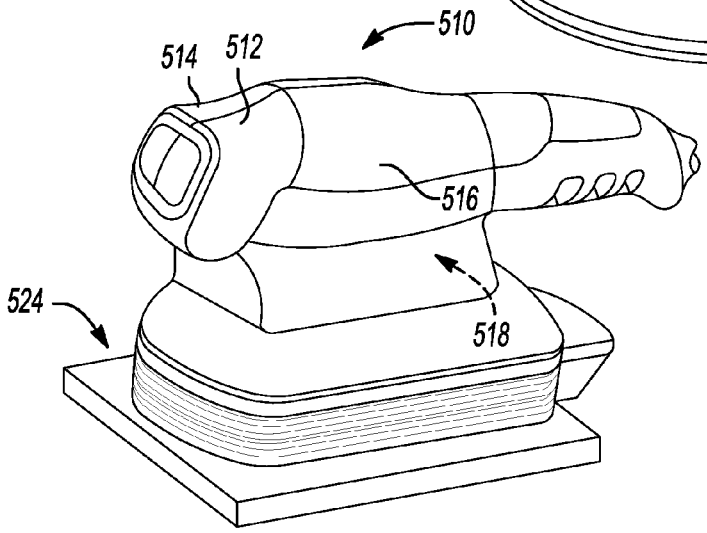
Figure 31:
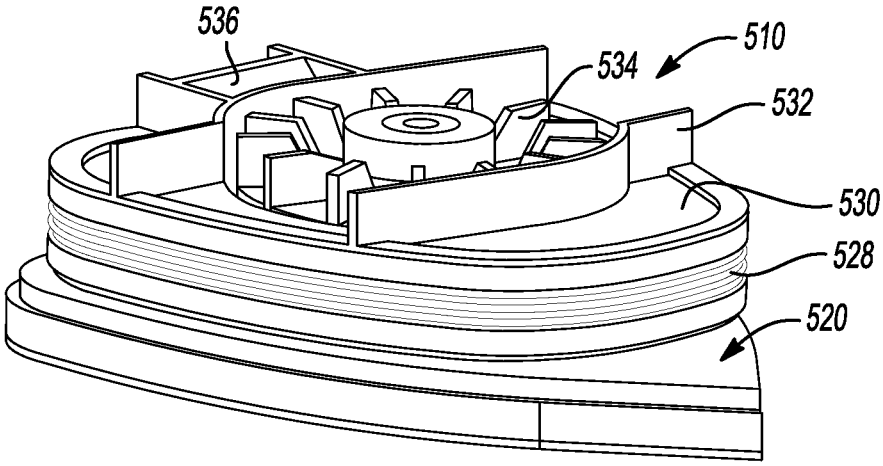
FIG. 31 is a side perspective view of the exemplary sander platen of FIG. 28 and shown cooperating with elastomeric bellows for coupling the sander platen to the tool body.
Figure 32:
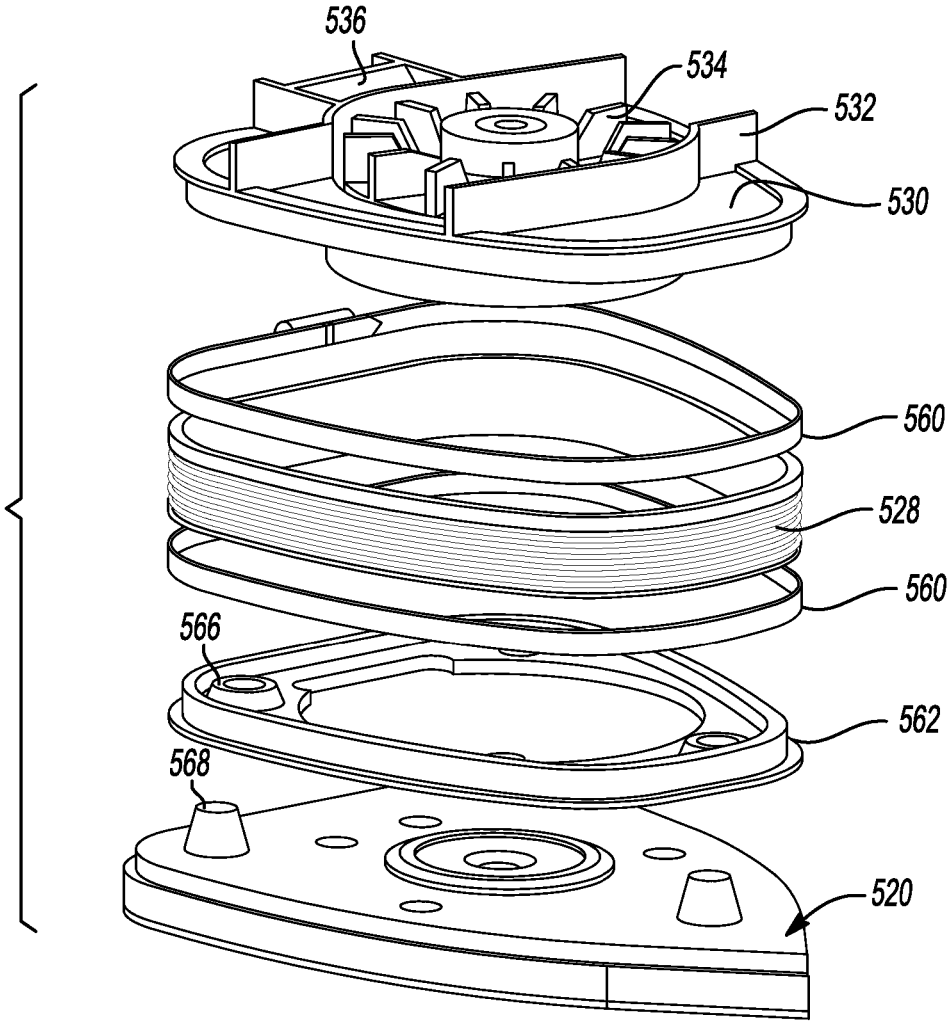
FIG. 32 is a side perspective exploded view of the bellows associated with the sander platen of FIG. 31.
Figure 33:
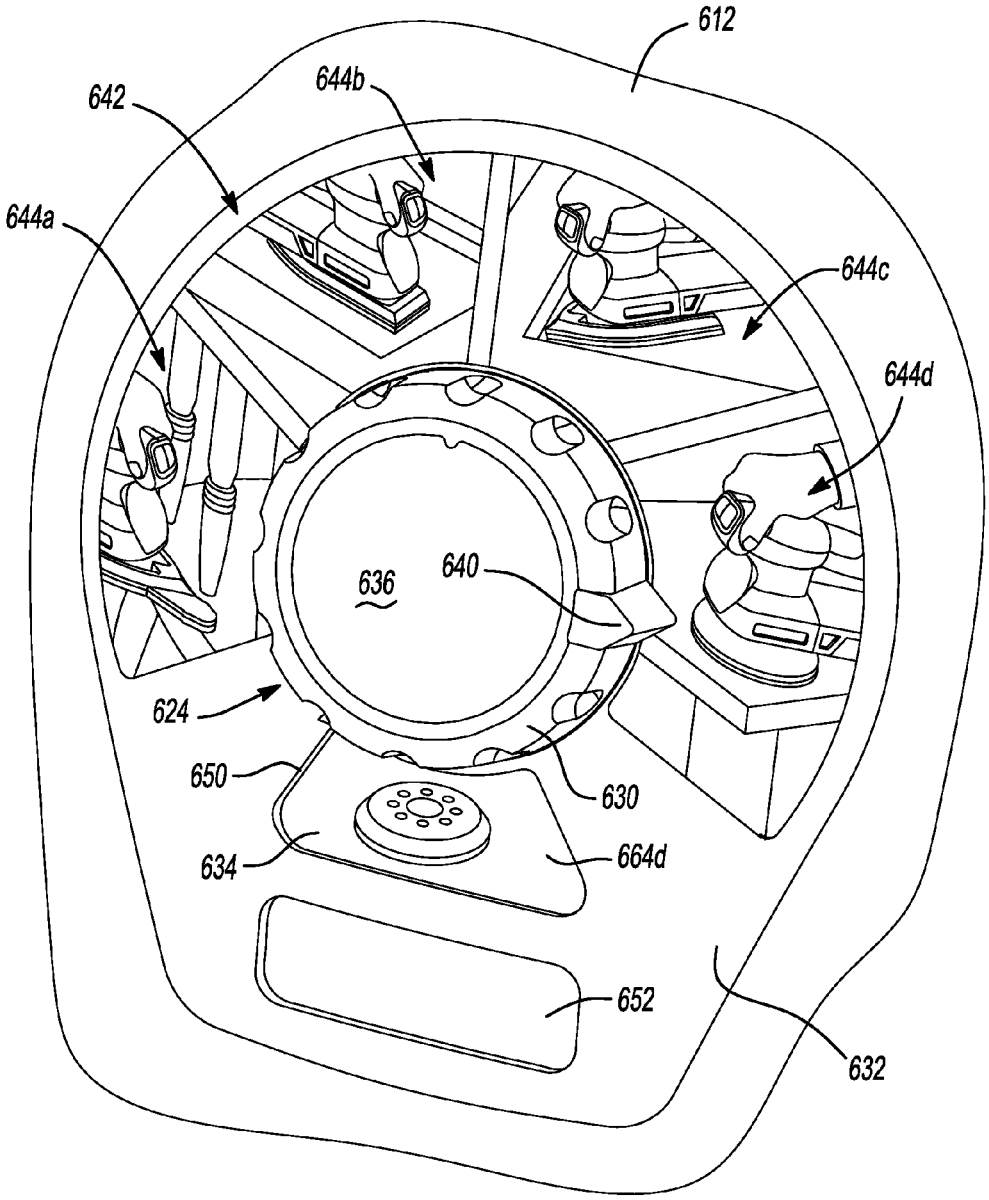
FIG. 33 is a front perspective view of a tool body and mode selector constructed in accordance to additional features of the present teachings.
Figure 34:
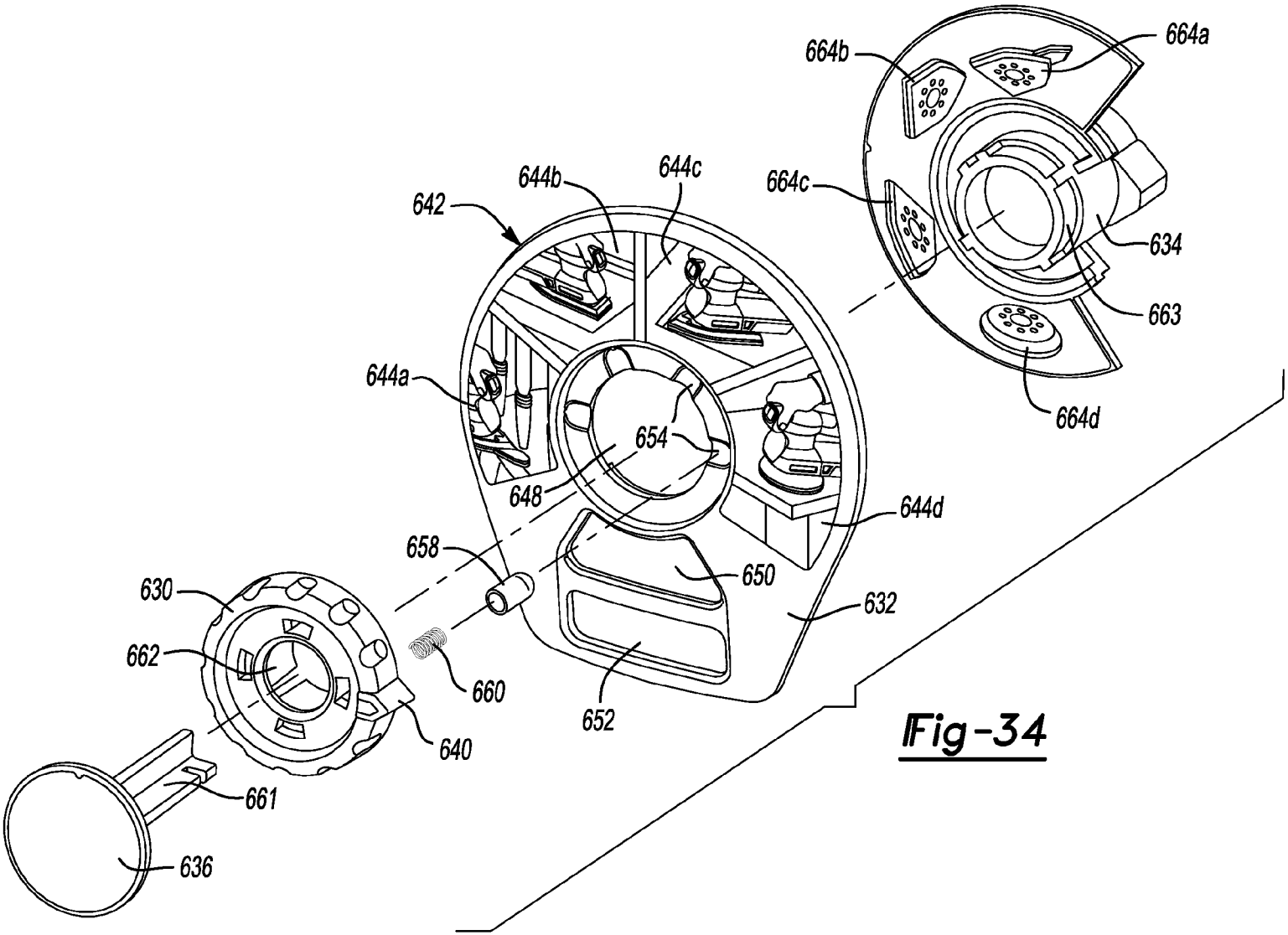
FIG. 34 is a front exploded view of the mode selector of FIG. 33 including a central hub, a knob, a control panel and a wheel.
Figure 35:
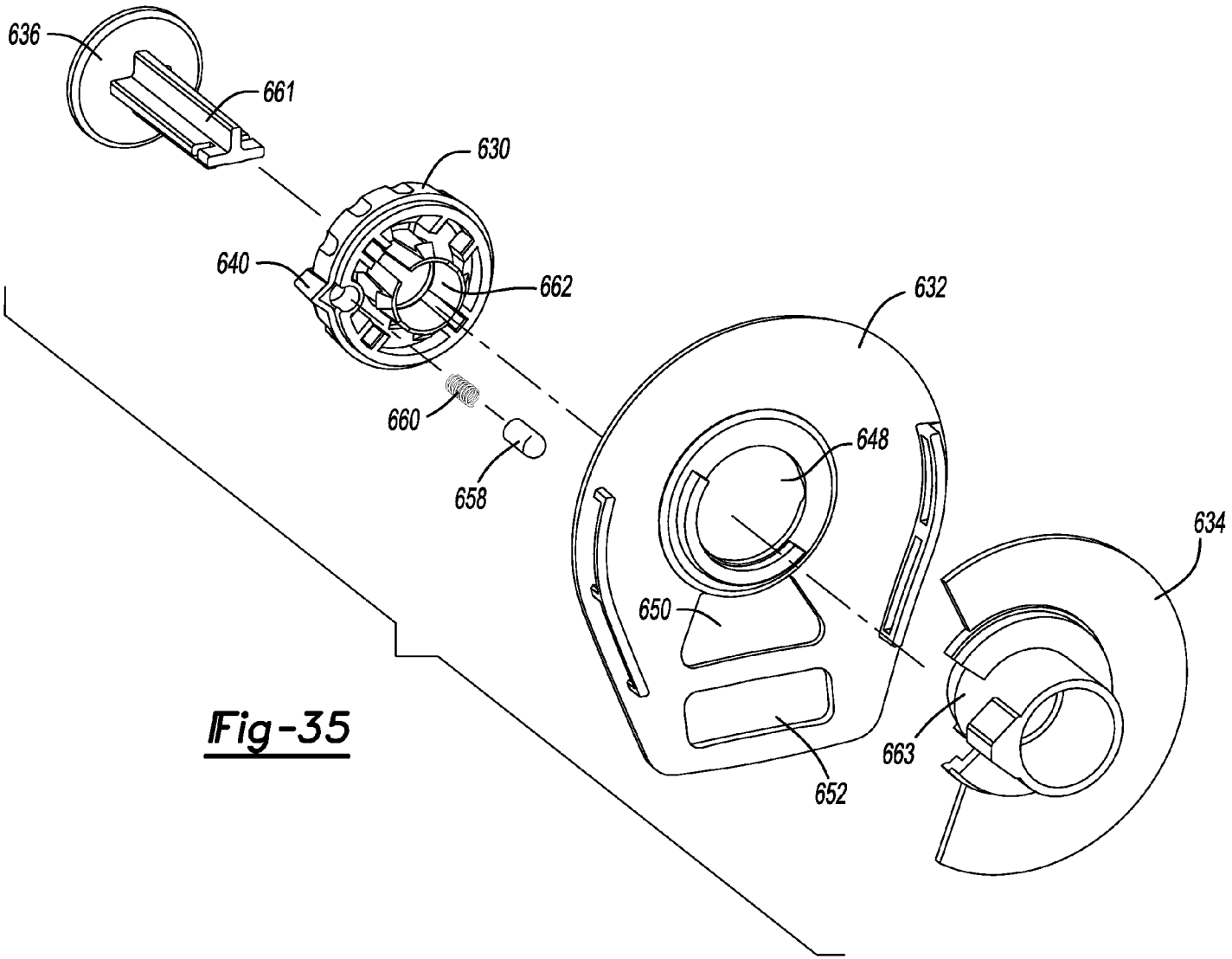
FIG. 35 is a rear perspective view of the mode selector of FIG. 34.

Turning now to FIGS. 28-30, a sander 510 constructed in accordance with additional features of the present teachings is shown. Except as otherwise described, the sander 510 can comprise the features as described herein with respect to other sanders. The sander 510 can include a tool body or housing 512 having a pair of clam shell portions 514 and 516. The sander 510 can further include a drive system 518 that is housed in a cavity defined by the clam shell portions 514 and 516. The tool body 512 and the drive system 518 can be conventional in their construction and operation, and as such, need not be discussed in significant detail. The drive system 518 can selectively couple with a plurality of platens. The platens are shown as a finishing sander platen 520 (FIG. 28), a random orbit sander platen 522 (FIG. 29) and a square finishing sander platen 524 (FIG. 32). The sander 510 provides elastomeric bellows 528 for securing a respective platen 520, 522, 524 to the tool body 512.

As shown in FIG. 29, the elastomeric bellows 528 is shown coupled between a plate 530 having a fan shroud 532 and an exemplary finishing sander platen 520. The fan shroud 532 can generally bound a fan 534 adapted for cooling the motor. The plate 530 can further define a dust chute 536 that is configured to exhaust air through a dust extraction chute (such as dust extraction chute 20). Referring to FIG. 30, the elastomeric bellows 528 can couple between a pair of hose clips 560. The hose clips 560 can couple on opposite ends to the plate 530 and a securing plate 562. In one example, the securing plate 562 can define bosses 566 for selectively receiving pegs 568 formed on the finishing sander platen 520. The elastomeric bellows 528 provides an enclosure for effective dust extraction.

Turning now to FIGS. 33-37, a mode selector 624 constructed in accordance to additional features of the present teachings will be described. The mode selector 624 can be operably disposed on a tool body 612 and can include a movable member 630, a control panel 632, a wheel 634 (FIG. 34) and a central hub 636. The movable member 630 can be in the form of a dial or knob. The movable member 630 can have an indicator 640 formed thereon. The control panel 632 can include a pictorial key 642 that includes graphics in a first zone 644*a*, a second zone 644*b*, a third zone 644*c* and a fourth zone 644*d*. As will become appreciated, the movable member can be configured to rotate, such that the indicator 640 is aligned with a preferred graphic on the pictorial key 642 according to the desired sanding task. The control panel 632 can also define an opening 648, a window 650 and a button passage 652. The control panel 632 can also define recesses 654 adjacent to the opening 648 for selectively receiving a cap 658 that is biased by a spring 660 in a nested position. The biased cap 658 can give a user positive tactile feedback that the movable member 630 is located at the desired position aligned with a respective zone 644*a*-644*d* of the pictorial key 642. In an assembled position, a stem 661 of the central hub 636 locates through an opening 662 formed in the movable member 630, through the opening 648 in the control panel 632 and couples with a hub 663 on the wheel 634. The movable member 630, the central hub 636 and the wheel 634 can then collectively rotate relative to the opening 648 of the control panel 632.

Figure 37:
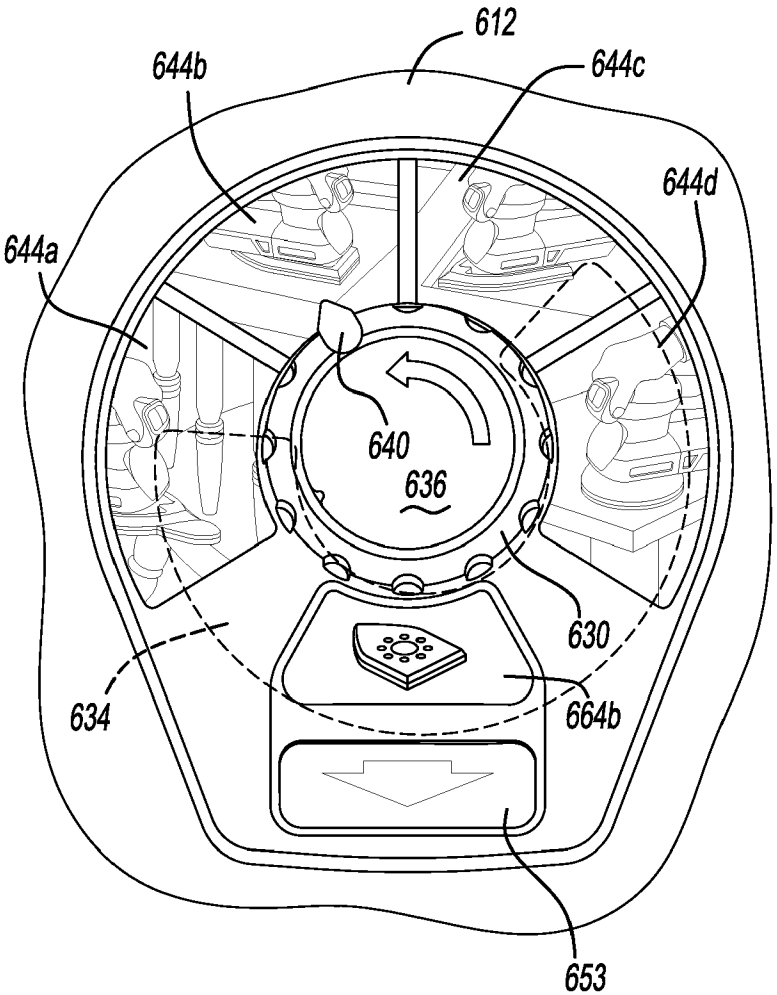
FIG. 37 is a front view of the mode selector illustrating the knob in a second position corresponding to the second image of the wheel being viewable through the window in the control panel.
Figure 36:
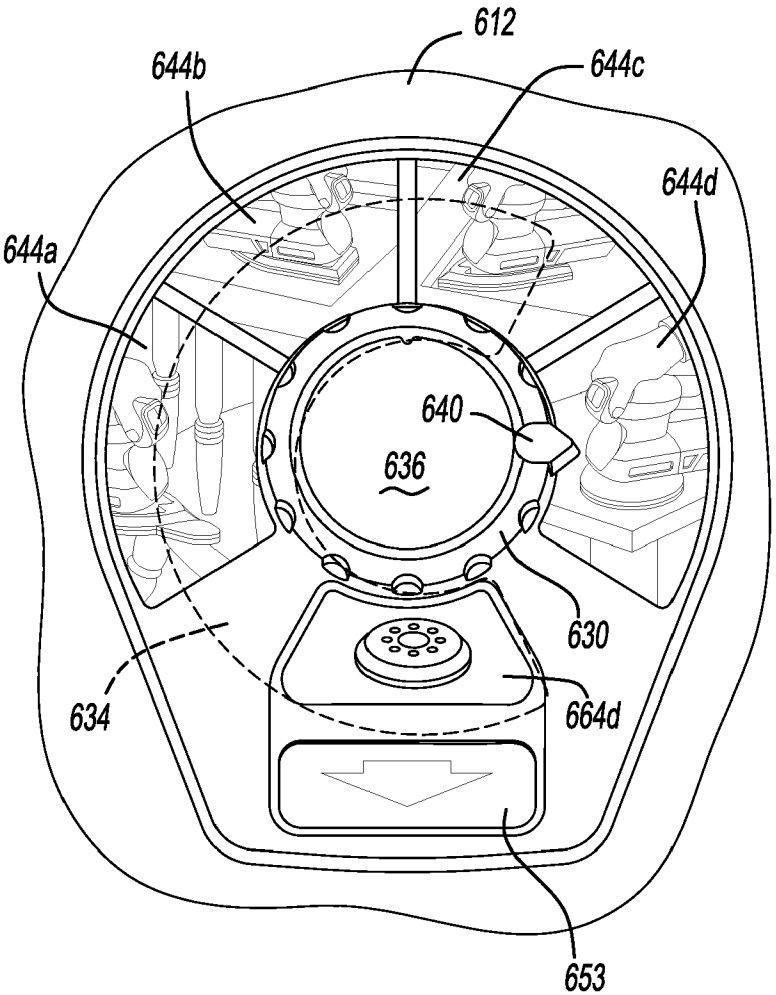
FIG. 36 is a front view of the mode selector shown with the knob located in a fourth position revealing a fourth image of the wheel through a window formed in the control panel.

The wheel 634 can include a first image 664*a*, a second image 664*b*, a third image 664*c*, and a fourth image 664*d*. The wheel 634 is fixed for rotation with the movable member 630, such that one of the first through fourth images 664*a*-664*d* can be viewable through the window 650. The images 664*a*-664*d* correspond with the appropriate graphic 644*a*-644*d* on the pictorial key 642 according to the desired task identified by the user. Explained further, and as illustrated in FIGS. 36-37, a user can rotate the movable member 630 from the location shown in FIG. 36 to the location shown in FIG. 37 when it is desired to change the sanding task. While not expressly described here, rotation of the movable member 630 can cooperate with a speed control switch, such as the speed control switch 188 to correspond with first and second speeds of the motor as described above in relation to FIGS. 20-22.

As illustrated in FIG. 36, the movable member 630 is shown rotated to a location, such that the indicator 640 is pointing at the fourth zone 644*d*. Also shown in FIGS. 36 and 37, a button 653 constructed similar to the button 30 described above is shown extending through the button passage 652. Because the movable member 630 is rotatably fixed with the wheel 634, this position corresponds to the fourth image 664*d* of the wheel 634 to be viewable through the window 650 of the control panel 632. In the example shown in FIG. 37, the user can rotate the movable member, such as in a counterclockwise direction until the indicator 640 is pointing at the second zone 644*b* of the pictorial key 642. In this position, the second image 664*b* is viewable through the window 650 of the control panel 632.

While not specifically shown, those skilled in the art will appreciate that the first image 664*a* of the wheel 634 will be viewable through the window 650 when the indicator 640 is pointing at the first zone 644*a* of the pictorial key 642. Similarly, the third image 644*c* of the wheel 634 will be viewable through the window 650 of the control panel 632 when the indicator 640 is pointing at the third zone 644*c* of the pictorial key 642. According to additional examples, the respective images 664*a*-664*d* can be provided with different colors indicating that some of the selected modes of sanding can include a change in motor speed. It is also appreciated that the mode selector 624 and related features can be configured for operation with any of the sanders described herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A tool for moving an abrasive media, the tool comprising:

a tool body;

a drive system housed in the tool body and including an output member;

a retaining member disposed on the tool body;

a first platen having a first attachment hub that selectively couples with the retaining member in an installed position, the first platen having a first rotatable member that selectively attaches to the output member in a first mode of operation;

a second platen having a second attachment hub that selectively couples with the retaining member in an installed position, the second platen having a second rotatable member that selectively attaches to the output member in a second mode of operation; and a mode selector disposed on the tool body and having a movable member and a key, wherein the movable member is movable between at least a first position corresponding to a first output member speed and a second position corresponding to a second output member speed and wherein the movable member is substantially aligned with a first zone on the key that corresponds to the first platen in the first position and second zone on the key that corresponds to the second platen in the second position.

2. The tool of claim 1 wherein the first rotatable member of the first platen is mounted for an orbit having a first offset relative to the output member and the second rotatable member of the second platen is mounted for an orbit having a second offset relative to the output member, wherein the first and second offsets are distinct.

3. The tool of claim 1 wherein the first rotatable member comprises a first fan having a first counterbalance disposed thereon and wherein the second rotatable member comprises a second fan having a second counterbalance disposed thereon and wherein the first and second counterbalances have distinct masses.

4. The tool of claim 3 wherein the first platen is an orbital platen configured for orbital sander in the installed position and the second platen is a random orbital platen configured for random orbital sander in the installed position.

5. The tool of claim 1 wherein the retaining member comprises a wireframe that selectively nests in respective grooves defined around each of the respective first and second attachment hubs in the installed position.

6. The tool of claim 5, further comprising a button disposed on the tool body, the button cooperating with the wireframe and movable to a release position to spread the wireframe and release the wireframe from the respective grooves to exchange between the first and second platens.

7. The tool of claim 6 wherein a chamfered annular leading edge is defined on each of the first and second attachment hubs respectively, wherein movement of a respective first or second platen to the installed position causes the annular leading edge to spread the wireframe until continued movement toward the installed position causes the wireframe to nest in the respective grooves.

8. The tool of claim 1, further comprising a third platen having a third attachment hub that selectively couples with the retaining member in an installed position, the third platen having a third rotatable member that selectively attaches to the output member in a third mode of operation; and wherein the first platen defines an iron-shaped profile having a substantially flat first end and a substantially pointed second end, the first platen comprising a dust chute arranged proximate to the substantially pointed second end, and wherein the third platen defines an iron-shaped profile having a substantially pointed first end and a substantially flat second end, the third platen comprising a dust chute arranged proximate to the substantially flat second end, wherein the substantially flat first end of the first platen is aligned with a dust extraction portion on the forward end of the tool in the installed position and the substantially pointed first end of the third platen is aligned with the dust extraction portion of the tool in the installed position.

9. The tool of claim 8 wherein the movable member is substantially aligned with a third zone on the key that corresponds to the third platen.

10. The tool of claim 1, further comprising a speed control switch that communicates with the mode selector, wherein the mode selector defines a rib that cams across an input of the speed control switch upon movement of the mode selector to toggle between the first output member speed and the second output member speed.

11. The tool of claim 1 wherein the tool body defines a dust extraction portion; and wherein at least one of the first or second platens defines a first dust chute arranged on a first end and a second dust chute defined on an opposite second end, and wherein the first dust chute is aligned with the dust extraction portion in a first installed position and the second dust chute is aligned with the dust extraction portion in a second installed position, wherein the first end of the at least one of the first or second platens is rotated substantially 180° relative to the output member between the first and second installed positions.

12. The tool of claim 1 wherein the first and second zone of the key comprises a picture of the first and second platen, respectively and wherein the key further includes a pictorial representation of a work surface suitable for sanding with a selected first or second platen.

13. The tool of claim 12 wherein the mode selector comprises:

a control panel defining an opening and a window, the movable member being at least partially received by the opening; and a wheel having at least a first and a second image thereon, the wheel being coupled for rotation with the movable member and aligning one of the first or second images for viewing through the window during rotation of the movable member to correspond with the alignment of an indicator on the movable member with the first or second zone on the key.

14. A tool for moving an abrasive media, the tool comprising:

a tool body;

a drive system housed in the tool body and including an output member;

a retaining member comprising a wireframe disposed on the tool body;

a first platen having a first attachment hub that defines a first groove that selectively receives the retaining member in an installed position, the first platen having a first rotatable member that selectively attaches to the output member in a first mode of operation;

a second platen having a second attachment hub that defines a second groove that selectively receives the retaining member in an installed position, the second platen having a second rotatable member that selectively attaches to the output member in a second mode of operation;

a button disposed on the tool body, the button cooperating with the wireframe and movable to a release position that spreads the wireframe and releases the wireframe from the respective first and second grooves to exchange between the first and second platens.

15. The tool of claim 14 further comprising:

a mode selector disposed on the tool body and having a movable member and a pictorial key, wherein the movable member is movable between at least a first position corresponding to a first output member speed and a second position corresponding to a second output member speed and wherein the movable member is substantially aligned with a first graphic on the pictorial key that corresponds to the first platen in the first position and second graphic on the pictorial key that corresponds to the second platen in the second position; and wherein the first platen is an orbital platen configured for orbital sander in the installed position and the second platen is a random orbital platen configured for random orbital sander in the installed position.

16. The tool of claim 15 wherein the first rotatable member of the first platen is mounted for an orbit having a first offset relative to the output member and the second rotatable member of the second platen is mounted for an orbit having a second offset relative to the output member, wherein the first and second offsets are distinct and wherein the first rotatable member comprises a first fan having a first counterbalance disposed thereon and wherein the second rotatable member comprises a second fan having a second counterbalance disposed thereon and wherein the first and second counterbalances have distinct masses.

17. The tool of claim 14, further comprising a third platen having a third attachment hub that selectively couples with the retaining member in an installed position, the third platen having a third rotatable member that selectively attaches to the output member in a third mode of operation; and wherein the first platen defines an iron-shaped profile having a substantially flat first end and a substantially pointed second end, the first platen comprising a dust chute arranged proximate to the substantially pointed second end, and wherein the third platen defines an iron-shaped profile having a substantially pointed first end and a substantially flat second end, the third platen comprising a dust chute arranged proximate to the substantially flat second end, wherein the substantially flat first end of the first platen is aligned with a forward end of the tool in the installed position and the substantially pointed first end of the third platen is aligned with the forward end of the tool in the installed position.

18. A method comprising:

providing a tool with a tool body, a drive system and a first and second platen, the tool body having a mode selector including a movable member and a key, the drive system having an output member;

moving the movable member to one of a first position or a second position, the first position corresponding to the first platen and associated with a first output member speed and the second position corresponding to the second platen and associated with a second output member speed; and mounting one of the first or second platen to the tool body according to the selected first or second position.

19. The method of claim 18 wherein mounting one of the first or second platens to the tool body comprises:

urging an attachment hub associated with a respective first or second platen into engagement with a wireframe retaining member disposed on the tool body;

further urging the attachment hub into engagement with the wireframe retaining member such that the wireframe retaining member rides over a chamfered annular leading edge defined on the attachment hub and spreads outwardly to receive the wireframe retaining member at least partially therearound; and nesting the wireframe retaining member into a groove defined on the selected attachment hub.

* * * * *